US009863418B2

(12) United States Patent
Schumann

(10) Patent No.: US 9,863,418 B2
(45) Date of Patent: Jan. 9, 2018

(54) PUMP SYSTEM

(71) Applicant: Laverne Schumann, Blue Grass, IA (US)

(72) Inventor: Laverne Schumann, Blue Grass, IA (US)

( * ) Notice: Subject to any disclaimer, the term of this patent is extended or adjusted under 35 U.S.C. 154(b) by 0 days.

(21) Appl. No.: 14/808,820

(22) Filed: Jul. 24, 2015

(65) Prior Publication Data

US 2016/0025091 A1 Jan. 28, 2016

Related U.S. Application Data

(60) Provisional application No. 62/028,778, filed on Jul. 24, 2014, provisional application No. 62/067,599, filed on Oct. 23, 2014.

(51) Int. Cl.
*F04C 14/26* (2006.01)
*F01M 1/02* (2006.01)
(Continued)

(52) U.S. Cl.
CPC ..... *F04C 14/26* (2013.01); *F01M 1/02* (2013.01); *F01M 1/16* (2013.01); *F01M 13/04* (2013.01); *F04C 2/086* (2013.01); *F04C 2/10* (2013.01); *F04C 2/14* (2013.01); *F04C 13/005* (2013.01); *F04C 14/24* (2013.01); *F01M 2013/026* (2013.01); *F01M 2013/0466* (2013.01);
(Continued)

(58) Field of Classification Search
CPC .. F04C 2/02; F04C 2/08; F04C 2/1912; F04C 25/06; F04C 25/0088; F04C 2210/26; F04C 15/0053; F04C 13/007; F04C 14/24; F04C 14/26; F04B 17/00; F04B 53/04; F04B 53/06; F04B 53/20; F04B 39/16; F02B 29/0468
See application file for complete search history.

(56) References Cited

U.S. PATENT DOCUMENTS 1,684,910 A * 9/1928 Cooper ..... F04C 15/0053 184/6.23
1,795,579 A 3/1931 Storey
(Continued)

FOREIGN PATENT DOCUMENTS

JP 09126153 5/1997

OTHER PUBLICATIONS

PCT/US2015/042059; Notification of Transmittal of the International Search Report and the Written Opinion of the International Searching Authority, or the Declaration; dated Nov. 9, 2015.

*Primary Examiner* — Charles Freay
*Assistant Examiner* — Kenneth J Hansen
(74) *Attorney, Agent, or Firm* — Hamilton IP Law, PC; Jay R. Hamilton; Charles Damschen

(57) ABSTRACT

A rotary pump may include a rotary cover and a rotary housing that may be engaged with one another during operation. A ring gear may be positioned within an internal portion of the rotary cover and rotary housing, and an inner gear may be positioned within a portion of the ring gear. The rotary pump may be configured with a pressure relief portion that may be in fluid communication with an outlet of the pump. The rotary pump may be configured such that pressurized fluid passing through the pressure relief portion is routed to an inlet of the rotary pump.

16 Claims, 18 Drawing Sheets

(51) Int. Cl.

| | |
|---|---|
| ***F01M 1/16*** | (2006.01) |
| ***F01M 13/04*** | (2006.01) |
| ***F04C 2/14*** | (2006.01) |
| ***F04C 2/08*** | (2006.01) |
| ***F04C 2/10*** | (2006.01) |
| ***F04C 13/00*** | (2006.01) |
| ***F04C 14/24*** | (2006.01) |
| *F04C 15/00* | (2006.01) |
| *F01M 13/02* | (2006.01) |
| *F04C 11/00* | (2006.01) |

(52) U.S. Cl.
CPC .... *F01M 2013/0483* (2013.01); *F04C 11/005* (2013.01); *F04C 15/008* (2013.01); *F04C 15/0061* (2013.01)

(56) References Cited

U.S. PATENT DOCUMENTS

| | | | | |
|---|---|---|---|---|
| 2,287,318 | A | 6/1942 | Frederic | |
| 2,641,192 | A * | 6/1953 | Lindberg | F04C 2/14 277/382 |
| 2,704,035 | A | 3/1955 | Bader | |
| 2,816,513 | A | 12/1957 | Watson | |
| 3,053,191 | A | 9/1962 | Weigert | |
| 3,130,682 | A | 4/1964 | Meads | |
| 4,706,968 | A | 11/1987 | Orlowski | |
| 5,810,571 | A * | 9/1998 | Cross | F04C 2/086 184/31 |
| 5,825,110 | A | 10/1998 | Page | |
| 5,879,140 | A | 3/1999 | Ellison | |
| 6,824,486 | B2 | 11/2004 | Maeno et al. | |
| 7,797,937 | B2 | 9/2010 | Endicott et al. | |
| 8,038,416 | B2 | 10/2011 | Ono et al. | |
| 8,398,381 | B1 * | 3/2013 | Schumann | F04B 17/05 417/304 |
| 2004/0045609 | A1 * | 3/2004 | Apostolides | F01M 11/0408 137/560 |
| 2005/0098385 | A1 * | 5/2005 | Ono | F04C 14/065 184/6.5 |
| 2006/0029509 | A1 | 2/2006 | Kurata et al. | |
| 2007/0237665 | A1 | 10/2007 | Holtzapple et al. | |
| 2010/0051388 | A1 * | 3/2010 | Clark | B01D 46/30 184/6.24 |
| 2011/0014080 | A1 | 1/2011 | Robillard | |
| 2013/0146039 | A1 | 6/2013 | Pursifull | |
| 2014/0086763 | A1 | 3/2014 | Osterhaus et al. | |

* cited by examiner

PUMP SYSTEM

CROSS REFERENCE TO RELATED APPLICATIONS

This non-provisional utility patent application claims the filing priority from provisional U.S. Pat. App. No. 62/028,778 filed on Jul. 24, 2014 and 62/067,599 filed on Oct. 23, 2014, all of which are incorporated by reference herein in their entireties.

FIELD OF INVENTION

This invention relates generally to pumps and equipment used therewith.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

BACKGROUND

Many internal combustion engine oil pumps are of the gear pump type wherein the drive gear is connected to the engine camshaft, or other rotational power source. The drive gear, in turn, rotates an idler gear, and the pump consists of a main body and cover housing, which are affixed to one another during use. Other engine oil pumps use a rotary gear set having a rotor gear and a stator ring gear. The cover housing may also include a relief valve. An oil inlet or "pick-up tube" is often mounted on the cover housing and is located within the engine pan sump, permitting oil to be drawn into the pump from the crank case.

In high performance engines such as those used in race cars, the high engine RPM causes rapid wear in the oil pump, as such pumps are built to close tolerances in order to achieve the high oil flow necessary to lubricate the rapidly rotating engine. Conventional internal combustion engine oil pumps utilize a drive shaft, driven from the engine camshaft or ignition distributor, and a driven gear is mounted upon the lower end of the drive shaft.

BRIEF DESCRIPTION OF THE FIGURES

The accompanying drawings, which are incorporated in and constitute a part of this specification, illustrate embodiments and together with the description, serve to explain the principles of the methods and systems.

DETAILED DESCRIPTION - LISTING OF ELEMENTS

Figure 1:
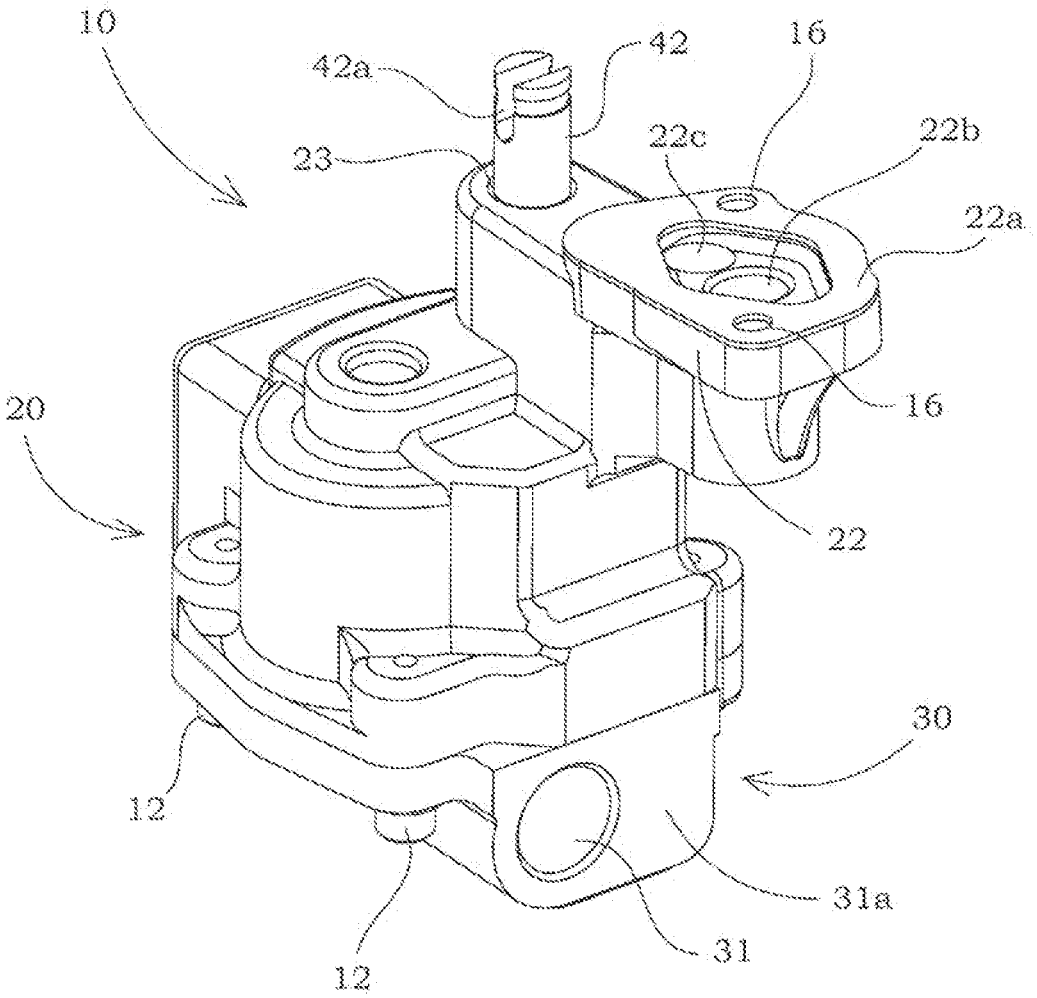
FIG. 1 provides a perspective view of one embodiment of a pump constructed according to the present disclosure.

| ELEMENT DESCRIPTION | ELEMENT # |
|---|---|
| Pump | 10 |
| Fastener | 12 |
| Diffuser screen | 14 |
| Aperture | 16 |
| Pick-up tube | 18 |
| Main body | 20 |
| Mounting base | 22 |
| Outlet interface | 22a |
| Mounting passage | 22b |
| Pump outlet port | 22c |
| Pump outlet passage | 22d |
| Drive gear shaft bore | 23 |
| Chamfer relief | 23a |
| Drive gear shaft bore groove | 23b |

-continued

| DETAILED DESCRIPTION - LISTING OF ELEMENTS | |
|---|---|
| ELEMENT DESCRIPTION | ELEMENT # |
| Cover housing interface surface | 24 |
| Gear chamber | 25 |
| Radial inlet port | 26 |
| Radial inlet port passage | 26a |
| Oil feed drive gear trough | 27a |
| Oil feed idler gear trough | 27b |
| Axial gear interface surface | 28a |
| Radial gear interface surface | 28b |
| Idler gear shaft | 29 |
| Cover housing | 30 |
| Inlet channel | 31 |
| Pick-up tube interface | 31a |
| Anticavitation groove | 32 |
| Main body interface surface | 33 |
| Pressure relief inlet cavity | 34 |
| Pressure relief inlet | 34a |
| Pressure relief retainer channel | 34c |
| Pressure relief inlet cavity trough | 34d |
| Pressure relief outlet | 35 |
| Axial inlet port | 36 |
| Radial inlet port feed passage | 36a |
| Return channel | 38 |
| Drive gear | 40 |
| Drive gear shaft | 42 |
| Drive gear shaft connector | 42a |
| Drive gear shaft lower end | 42b |
| Drive gear tooth | 44 |
| Drive gear tooth dimple | 46 |
| Idler gear | 50 |
| Idler gear tooth | 54 |
| Idler gear tooth dimple | 56 |
| Spring | 62 |
| Valve | 64 |
| Spring connector | 66 |
| Spring retainer | 68 |
| First pressure relief channel | 72 |
| Cross channel | 73 |
| Second pressure relief channel | 74 |
| Rotary pump | 80 |
| Rotary gear set | 81 |
| Rotor gear | 82 |
| Rotor dimple | 82a |
| Rotor groove | 83 |
| Stator ring gear | 84 |
| Stator dimple | 84a |
| Stator groove | 85 |
| Stator radial bore | 86 |
| Rotary housing | 90 |
| Rotary cover | 90a |
| Outlet cavity | 91 |
| Outlet | 92 |
| Inlet cavity | 93 |
| Inlet | 94 |
| Pressure relief cavity | 95 |
| Plug | 95a |
| Pressure relief discharge | 96 |
| Pressure relief portion | 97 |
| Return channel | 98 |
| Return tube | 99 |
| Inner gear | 102 |
| Ring gear | 104 |

DETAILED DESCRIPTION

Before the present methods and systems are disclosed and described, it is to be understood that the methods and systems are not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems may be understood more readily by reference to the following detailed description of preferred embodiments and the examples included therein and to the Figures and their previous and following description.

Figure 2:
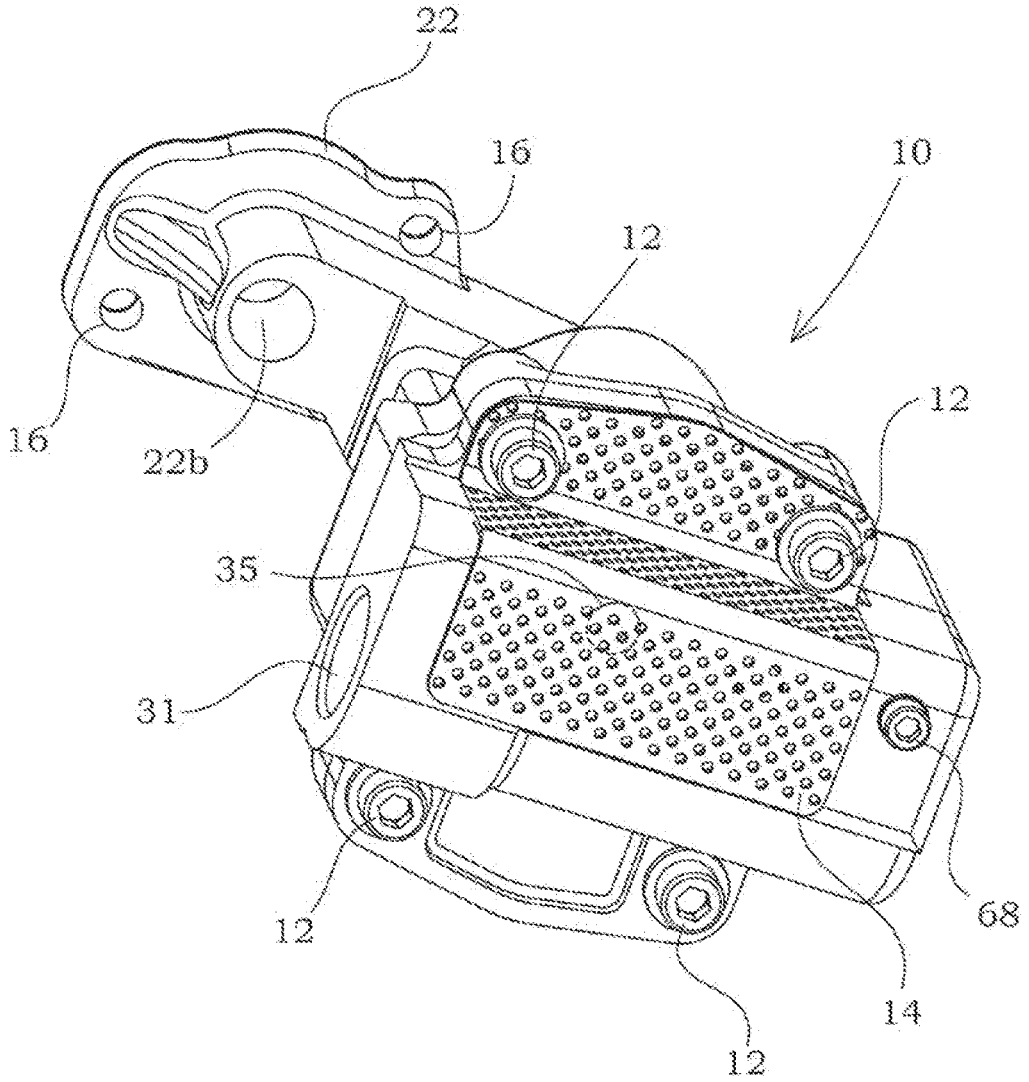
FIG. 2 provides a bottom perspective view of one embodiment of a pump constructed according to the present disclosure.

Referring now to the drawings, wherein like reference numerals designate identical or corresponding parts throughout the several views, FIG. 1 provides elevated perspective view of one embodiment of a pump 10 and/or pump system, and FIG. 2 shows a bottom perspective view thereof. The pump 10 generally may be comprised of a main body 20 and a cover housing 30, which may be fastened to one another via a plurality of fasteners 12 during use. The specific embodiments of pumps 10 and/or pump systems pictured herein are designed for use as an oil pump for an internal combustion engine. However, several aspects of pumps 10 and/or components thereof may be used with other types of pumps 10, and accordingly, the present disclosure is not limited to a specific type of pump 10 and/or pump system or applications thereof.

Figure 4:
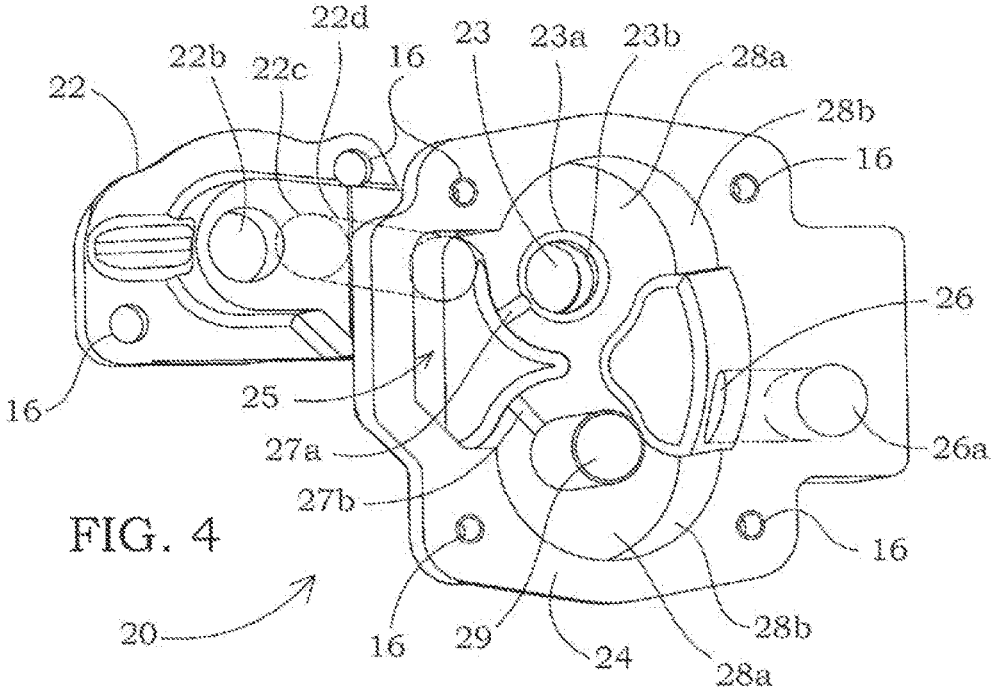
FIG. 4 provides a detailed view of the internal side of one embodiment of a main body constructed according to the present disclosure.

The internal portion of the main body 20 for one gear-to-gear embodiment of the pump 10 is shown in FIG. 4. Referring now to FIGS. 1, 2, and 4, it will be seen that in this embodiment a mounting base 22 may extend from the main body. In the embodiment of the pump 10 pictured herein, the mounting base 22 may serve to mount the pump 10 to a secure structure, which is typically the engine block of an internal combustion engine in a manner similar to that disclosed in U.S. Pat. No. 3,057,434, which is incorporated by reference herein in its entirety. In such pumps 10 an outlet interface 22*a* may be fashioned in the mounting base 22 to provide an interface between the pump 10 and the structure to which the pump 10 is mounted. The outlet interface 22*a* in the embodiment of the main body 20 pictured herein may surround a pump outlet port 22*c* through which pressurized fluid may exit the main body 20. The pump outlet port 22*c* may be fluidly connected to the gear chamber 25 via a pump outlet passage 23 (shown in FIG. 4) fashioned as an internal channel in the main body 20 and may be formed in a portion of the mounting base 22.

A mounting passage 22*b* may be fashioned in the mounting base 22 to provide for a fastener 12 that may engage both the pump 10 and the structure to which the pump 10 is mounted. In the particular embodiment pictured herein, a pump outlet port 22*c* may be positioned within the periphery of the outlet interface 22*a* and adjacent the mounting passage 22*b*. The pump outlet port 22*c* may be in fluid communication with a pump outlet passage 22*d* that may be formed in the main body 20, which pump outlet passage 22*d* may be in fluid communication with the gear chamber 25 of the main body 20 as previously described. Other mounting methods and/or structures may be used for the pump 10 according to the present disclosure. Accordingly, the scope of the pump 10 as disclosed and claimed herein is not limited by the particular mounting method and/or structure used to mount the pump 10 and/or pump system.

A gasket (not shown) may be positioned between the outlet interface 22*a* and the structure to which the pump 10 is mounted. A copper gasket may be especially useful for sealing the outlet interface 22*a* and the structure to which the pump 10 is mounted because it is malleable enough that the copper gasket material will form to imperfections in either the outlet interface 22*a* and/or structure to which the pump 10 is mounted, yet the copper gasket resists degradation due to heat and/or pressure because of the intrinsic properties of copper. A copper gasket may be configured for use with any embodiment of a pump, including but not limited to the pump 10 shown in FIG. 1 and the rotary pump 80 shown in FIG. 6A. It is contemplated that the periphery of a copper gasket configured for the pump 10 shown in FIG. 1 may follow the shape and dimensions of the outlet interface 22*a*. However, the copper gasket may be used with any outlet interface 22*a*, and therefore the size and/or dimensions thereof are in no way limiting to the scope of the copper gasket.

The internal portion of the main body 20 may include a gear chamber 25, which is best shown in FIG. 4. A cover housing interface surface 24 may surround the periphery of the gear chamber 25 and provide a surface for sealing the main body 20 to the cover housing 30. In the pictured embodiment, four apertures 16 may be fashioned in the main body 20 at various positions around the cover housing interface surface 24. The four apertures 16 in the main body 20 may correspond to four apertures 16 in the cover housing 30 (best shown in FIGS. 3A and 3B), and four fasteners 12. However, any number of apertures 16 and/or fasteners 12 may be used without limitation. The fasteners 12 may be configured as bolts in the embodiment pictured herein, and may be inserted into the corresponding apertures 16 in the main body 20 and the cover housing 30 to secure the main body 20 and the cover housing 30 to one another. Other types of fasteners may be used without limitation.

Sealing material, such as a gasket, o-ring linear, or silicon rubber, and/or other material without limitation may be placed between the main body 20 and the cover housing 30 at the cover housing interface surface 24 to enhance the seal there between. If an o-ring (not shown) is used, the cover housing interface surface 24 and/or main body interface surface 33 may be formed with a groove (not shown) therein that may be shaped similarly to the periphery of the main body 20, into which groove the o-ring may seat. The groove may be curved or square in cross-sectional shape and the cross-sectional shape of the o-ring may compliment that of the groove.

Figure 5A:
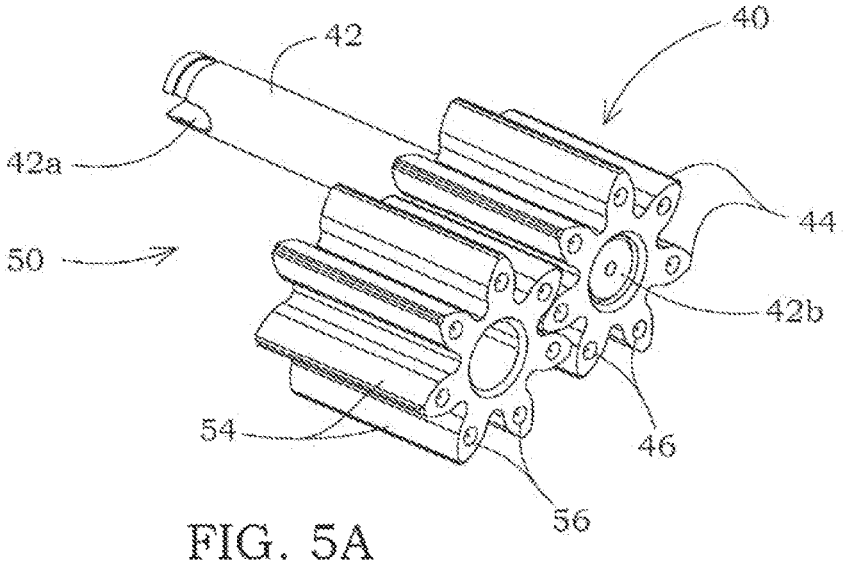
FIG. 5A provides a perspective view of one embodiment of a drive gear and idler gear constructed according to one aspect of the present disclosure.
Figure 5B:
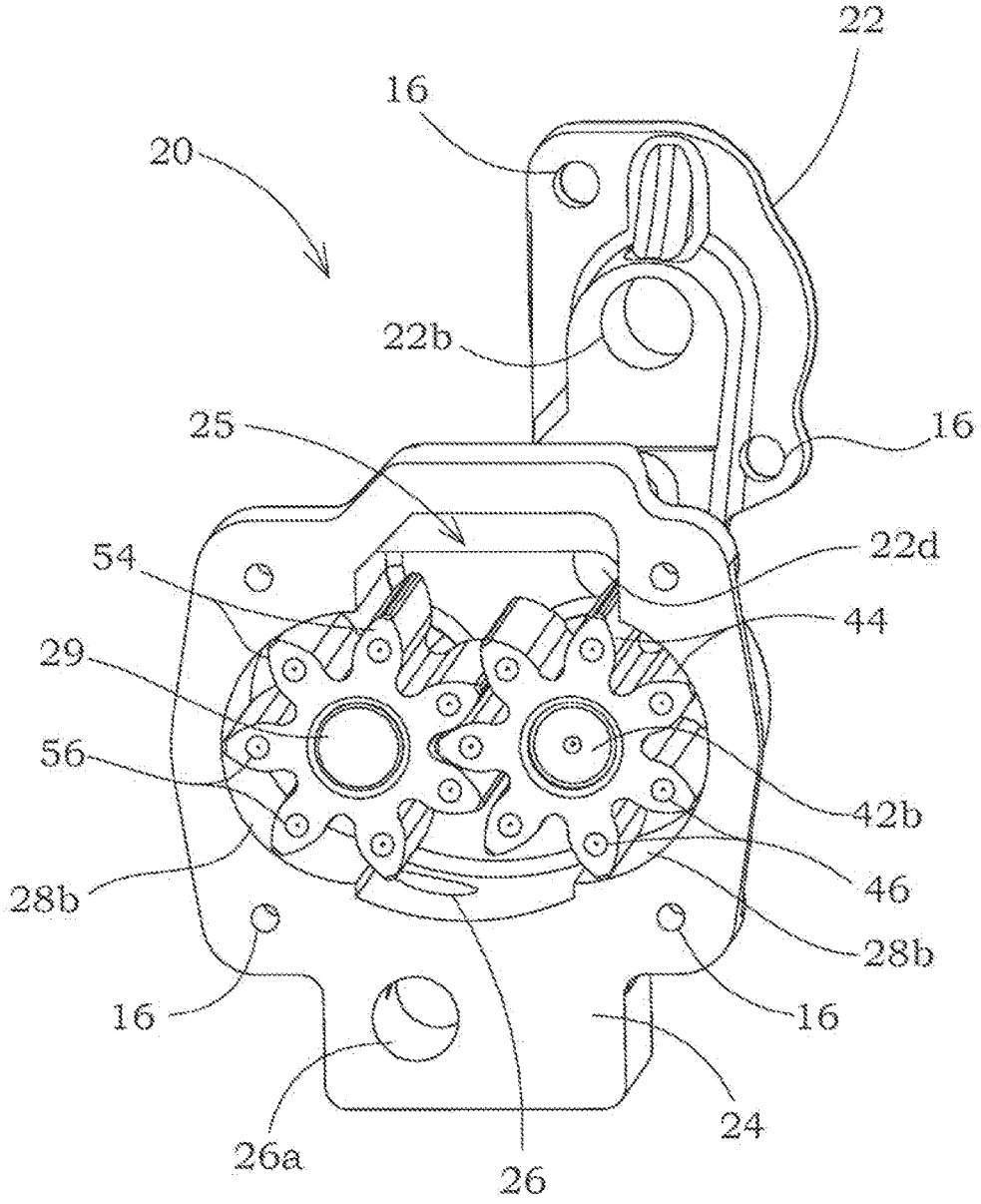
FIG. 5B provides a perspective view of one embodiment a drive gear and idler gear constructed according to one aspect of the present disclosure positioned in one embodiment of a main body.

A drive gear 40 and an idler gear 50, such as those shown in FIG. 5A, may be positioned in the gear chamber 25 (as shown in FIG. 5B) to energize fluid positioned in the gear chamber 25. A drive gear shaft 42 may be fixedly attached to the drive gear 40. The drive gear shaft 42 may disposed in the drive gear shaft bore 23 when the pump 10 is assembled. The drive gear shaft 42 may include a drive gear shaft connector 42*a* on the upper end thereof, which may protrude from the main body 20 as shown in FIG. 1. A rotational power source (not shown) may be operatively engaged with the drive gear shaft 42 at the drive gear shaft connector 42*a*. The drive gear shaft lower end 42*b* may be positioned adjacent an axial face of the drive gear 40 as shown in FIG. 5B. As will be apparent to those skilled in the art in light of the present disclosure, as the drive gear 40 rotates, the intermeshing of the drive gear teeth 44 with the idler gear teeth 54 may cause the idler gear 50 to rotate in a direction opposite to that of the drive gear 40. The idler gear 50 may be disposed for pivotal engagement with an idler gear shaft 29, which idler gear shaft 29 may be rigidly mounted to the main body 20 as shown in FIG. 4. In other embodiments of the pump 10 not pictured herein (such as that disclosed in U.S. Pat. No. 5,810,571, which is incorporated by reference herein in its entirety) the idler gear shaft 29 is pivotally mounted to the main body 20 and the idler gear 50 is fixedly mounted to the idler gear shaft 29.

Referring now to FIG. 4, one axial surface of the drive gear 40 may interface the main body 20 at the axial gear interface surface 28*a* adjacent the drive gear shaft bore 23, and one axial surface of the idler gear 50 may interface the main body 20 at the axial gear interface surface 28*a* adjacent the idler gear shaft 29. The radial surface of the drive gear 40 may interface the main body 20 at the radial gear interface surface 28*b* adjacent the drive gear shaft bore 23, and the radial surface of the idler gear 50 may interface the main body 20 at the radial gear interface surface 28*b* adjacent the idler gear shaft 29. An oil feed drive gear trough 27*a* and an oil feed idler gear trough 27*b* may be positioned in the respective axial gear interface surfaces 28*a* to allow oil positioned in the gear chamber 25 to migrate between one axial surface of the drive gear 40 and idler gear 50 and the main body 20.

In one aspect of the main body 20, a chamfer relief 23*a* may be fashioned in the drive gear shaft bore 23 adjacent the axial gear interface surface 28*a*, which is shown in FIG. 4. The chamfer relief 23*a* may allow oil positioned in the gear chamber 25 to migrate into the drive gear shaft bore 23 and subsequently lubricate the interface between the outer surface of the drive gear shaft 42 and the drive gear shaft bore 23. For even further lubrication, a drive gear shaft bore groove 23*b* may be fashioned in the drive gear shaft bore 23. In an aspect shown in FIG. 4, the drive gear shaft bore groove 23*b* may be formed primarily as a continuous spiral groove or rifling along the length of the drive gear shaft bore 23. This may allow oil located in the gear chamber 25 to migrate from the interior end of the drive gear shaft bore 23 (adjacent the drive gear 40) to the exterior of the main body 20 (adjacent the drive gear shaft connector 42*a*), thereby lubricating the entire interface between the drive gear shaft 42 and drive gear shaft bore 23. In other aspects, the drive gear shaft bore groove 23*b* may consist of a plurality of continuous grooves along the length of the drive gear shaft bore 23 or a portion thereof.

The main body 20 may be formed with a radial inlet port 26 adjacent the two radial gear interface surfaces 28*b* as best shown in FIG. 4. The radial inlet port 26 may be in fluid communication with a radial inlet port passage 26*a* formed in the main body 20. The radial inlet port passage 26*a* may extend to the cover housing interface surface 24 where it may interface and fluidly communicate with a radial inlet port feed passage 36*a* formed in the cover housing 30, which is described in detail below. The radial inlet port 26 may provide fluid to the inlet portion of the gear chamber 25 along the radial surface of the drive and idler gears 40, 50, which may allow the pump 10 to achieve a higher volumetric flow rate than the same pump 10 not configured with a radial inlet port 26. Testing has shown an increased volumetric flow rate of approximately forty percent (40%) in pumps 10 fashioned with a radial inlet port passage 26*a* compared to pumps 10 not having a radial inlet port passage 26*a*, but otherwise identical.

Figure 3A:
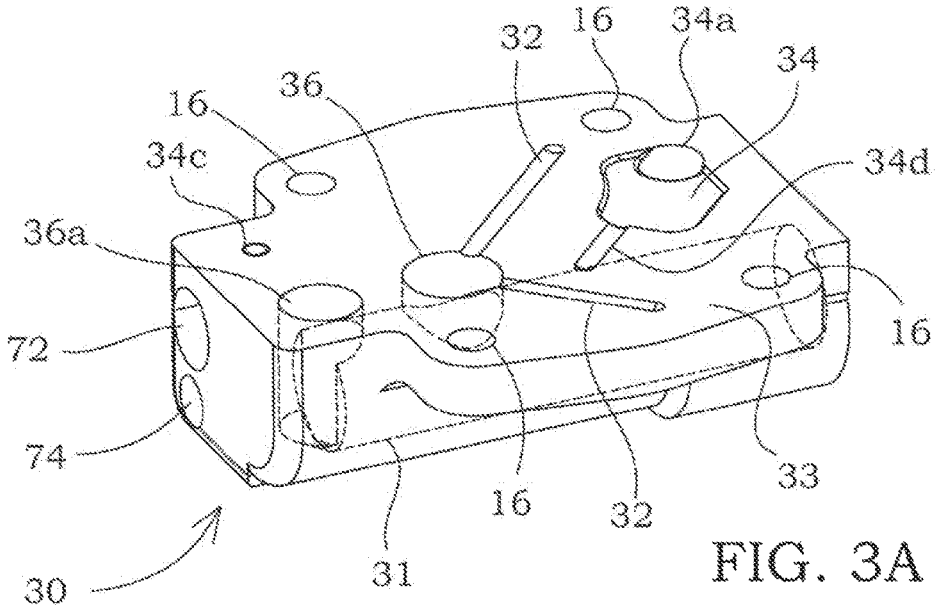
FIG. 3A provides a detailed side view of the internal side of one embodiment of a cover housing constructed according to the present disclosure.
Figure 3B:
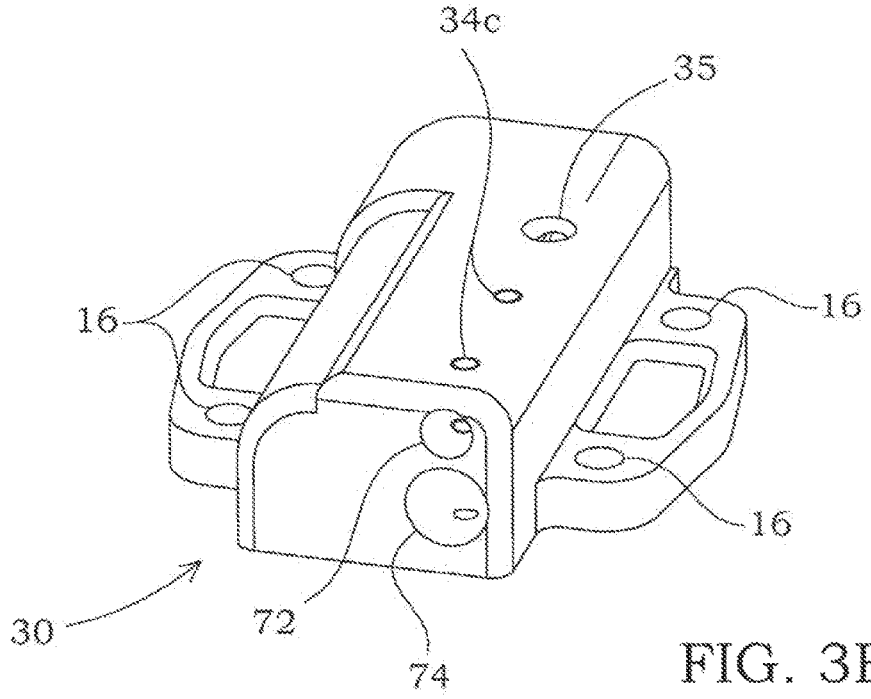
FIG. 3B provides a detailed perspective view of the external surface of one embodiment of a cover housing constructed according to the present disclosure.

A detailed view of the internal surface of the cover housing 30 is shown in FIG. 3A, and a detailed view of the external surface thereof is shown in FIG. 3B. The portion of the internal surface of the cover housing 30 that contacts the main body 20 is referred to as the main body interface surface 33 and may be essentially a mirror image of the cover housing interface surface 24. An inlet channel 31 may be formed in the cover housing 30, the external portion of which may be formed as a pick-up tube interface 31*a* (best shown in FIGS. 1 and 2). Supply fluid may be provided to the pump 10 via the inlet channel 31, which supply fluid may be oil from an oil sump located within an internal combustion engine.

Referring now to FIG. 3A, an axial inlet port 36 may be in fluid communication with the inlet channel 31 and may provide inlet fluid to the axial surface of the drive and idler gears 40, 50 when the pump 10 is assembled. A plurality of anti-cavitation grooves 32 may extend from the axial inlet port 36 to supply fluid to the axial surface of the drive and idler gears 40, 50 adjacent the cover housing 30 and to ensure that the pump 10 does not cavitate in situations of changing flow rates and/or pressures. A radial inlet port feed passage 36*a* may be fashioned in the main body interface surface 33, which radial inlet port feed passage 36*a* may correspond to the radial inlet port passage 26*a* formed in the cover housing interface surface 24 of the main body 20. Accordingly, supply fluid may pass from the pick-up tube interface 31*a* through the inlet channel 31 to the radial inlet port feed passage 36*a* in the cover housing 30 to the radial inlet port passage 26*a* in the main body and through the radial inlet port 26 to the gear chamber 25 in the main body 20 and encounter the drive and idler gears 40, 50 on the radial surface thereof. Additionally, supply fluid may pass from the pick-up tube interface 31*a* through the inlet channel 31 to the axial inlet port 36 in the cover housing 30 and encounter the drive and idler gears 40, 50 on an axial surface thereof such that the drive and idler gears 40, 50 may be supplied with fluid from two distinct surfaces and/or sources for increased volumetric flow of the pump 10.

Figure 3C:
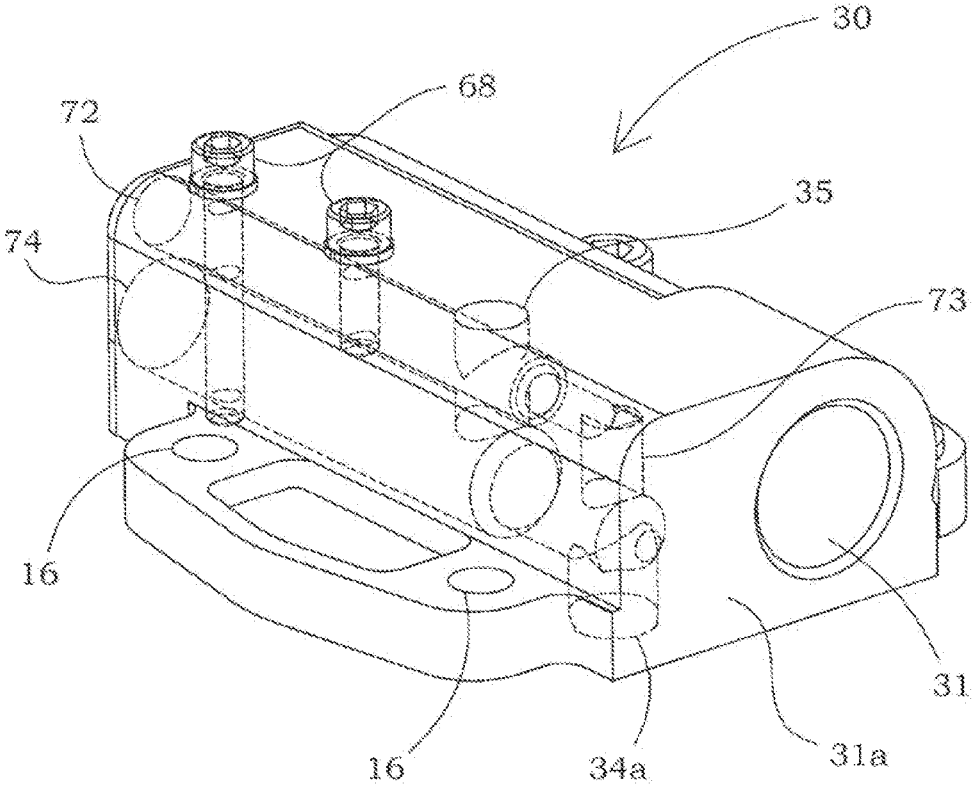
FIG. 3C provides a detailed view of one embodiment of a cover housing showing various internal elements as hidden lines.

The cover housing 30 also may be formed with a pressure relief inlet cavity 34 opposite the radial inlet port feed passage 36*a*. A plurality of pressure relief inlet cavity troughs 34*d* may extend from the pressure relief inlet cavity 34 to provide fluid to the axial surface of the drive and idler gears 40, 50 adjacent the cover housing 30 and may direct pressurized fluid within the gear chamber 25 to the pressure relief inlet 34*a*. A pressure relief inlet 34*a* may be positioned adjacent the pressure relief inlet cavity 34 for fluid communication with a first pressure relief channel 72. In one aspect of the cover housing 30 the first pressure relief channel 72 may be oriented parallel to the inlet channel 31, as best shown in FIG. 3C, which shows various internal elements of one embodiment of a cover housing 30 as hidden lines, and in which certain mechanical elements have been removed for purposes of clarity. The first pressure relief channel 72 may extend through the exterior wall of one side of the cover housing 30 as shown in FIGS. 3A and 3B, but one end of the first pressure relief channel 72 may be sealed. A pressure relief outlet 35 may be fashioned in the side of the cover housing 30 so that it is in fluid communication with the pressure relief channel 34*b* during predetermined conditions of sufficient pressure within the gear chamber 25.

One or more pressure relief retainer channels 34*c* may be fashioned to intersect the pressure relief channel 34*b* and engage a spring retainer 68, which is described in detail below. The spring retainer 68 may be threaded to engage a tapped pressure relief retainer channel 34*c*. However, in other aspects the spring retainer 68 and/or pressure relief retainer channel 34*c* may be smooth or may be engaged with one another using a structure and/or method other than threads. Accordingly, the spring retainer 68 may be engaged with the cover housing 30 through any method and/or structure known to those skilled in the art without limitation.

Figure 3D:
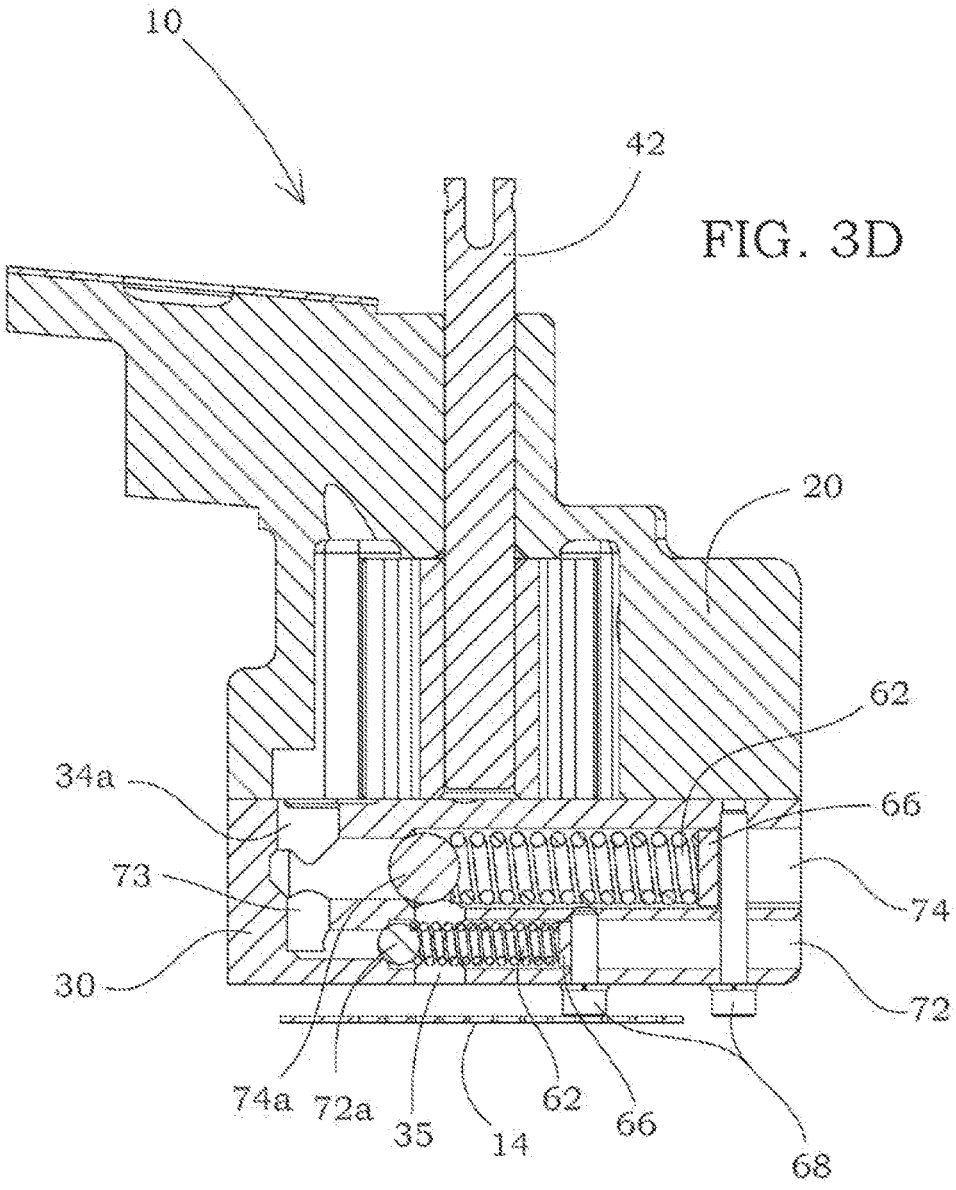
FIG. 3D provides a detailed cross-sectional view of one embodiment of a pump constructed according to the present disclosure.

A pressure relief assembly comprising a spring 62, valve 64, and spring connector 66 (as shown in FIG. 3D, which provides a cross-sectional view of one embodiment of the pump 10) may be engaged with one of the pressure relief channels 72, 74 of the cover housing 30 to allow pressurized fluid to be expelled from the gear chamber 25 via a conduit other than the pump outlet passage 22*d* upon certain predetermined conditions. Generally, the spring 62, valve 64, and spring connector 66, may be disposed in the first pressure relief channel 72 may be sized such that when the pump 10 is operating in a desired differential pressure range, the valve 64 prevents pressurized fluid within the gear chamber 35 from exiting through the pressure relief outlet 35. The valve 64 may be positioned adjacent the pressure relief outlet 35, followed by the spring 62 and the spring connector 66. The spring retainer 68 in conjunction with the spring 62 and spring connector 66 may serve to bias the valve in a direction toward the pressure relief outlet 35.

In an aspect, the spring retainer 68 may be fashioned as a bolt, but may be any structure known to those skilled in the art that is suitable for the particular application of the pump 10 and/or pump system. The amount of force by which the spring 62 resists compression may determine at least in part the pressure within the gear chamber 25 that will cause the valve 64 to open and allow pressurized fluid to exit the gear pump 10 via the pressure relief outlet 35. It is contemplated that the spring connector 66 may be fashioned as a washer, solid plate, or otherwise. These spring connectors 66 may serve as shims so that the assembly height of the pressure relief assembly 60 may be fine-tuned for optimal performance thereof.

In certain aspects it may be beneficial to offer a plurality of springs 62 of differing resistance so that the pressure at which the pressure relief assembly allows fluid to exit the main body 25 through the pressure relief outlet 35 may be adjusted by the user. The different springs 62 may be color-coded to correspond to a specific relief pressure. The spring 62 may be removed by disengaging the spring retainer 68 from the pressure relief retainer channel 34*c* and removing the spring connector 66 (best shown in FIG. 3D)

to access the spring 62. A diffuser screen 14 may be positioned over the pressure relief outlet 35, as shown in FIG. 2, so that when the valve 64 opens, the exiting fluid is disbursed in a wide spray pattern rather than a concentrated stream.

In the various aspects, the valve 64 in the pressure relief assembly 60 may be fashioned as a ball valve 64, which is best shown in FIG. 3D. Typical prior art valves 64 are fashioned as plug, cup, or spool valves. The ball valve 64 typically provides superior performance to other types of valves 64 in the presence of any foreign objects, which is common in motor oil applications of internal combustion engines. For example, if a piece of foreign material, such as carbon or paper, encounters the surface of the ball valve 64, the ball may rotate about the end of the spring 62 and/or pressure relief outlet 35 until the foreign material is expelled. Furthermore, the rotation of the ball against the pressure relief outlet 35 may fragment the piece of foreign material or dislodge it from the surface of the ball valve 64. Conversely, because of the leverage on a cylinder-shaped plug, a piece of foreign material positioned on a plug valve 64 often causes the valve 64 to stick in one position and malfunction. This problem is exacerbated by the closer tolerances required between the valve 64 and the pressure relief channel 34*b*, which may be as little as two thousands of an inch.

The cover housing 30 shown herein also may include a second pressure relief channel 74 fashioned therein, which second pressure relief channel 74 may be in fluid communication with the pressure relief inlet 34*a*, although other aspects may include only a first pressure relief channel 72. A pressure relief assembly analogous to that described above may be positioned in the second pressure relief channel 74. The two pressure relief assemblies may be sized differently volumetrically (e.g., the diameter of the first and second pressure relief channels 72, 74 may be different, as in the embodiment shown) and the springs 62 in each pressure relief assembly may be sized so that the respective valves 64 require different internal pressures in the pump 10 before the respective valve 64 opens.

The first and second pressure relief channels 72, 74 may be in fluid communication via a cross channel 73 that may extend from the first pressure relief channel 72 and into the second pressure relief channel 74. In this aspect the pressure relief outlet 35 may be in fluid communication with both pressure relief channels 72, 74, as best shown in FIG. 3D. Each pressure relief channel 72, 74 may have separate and distinct pressure relief outlets 35, or the two pressure relief channels 72, 74 may share a common pressure relief outlet 35.

As is clearly shown in FIG. 3D, the cross-sectional area of the second pressure relief channel 74 may be greater than that of the first pressure relief channel 72 by approximately thirty-five percent, but may be different in other aspects of the cover housing 30 not pictured herein. The first and second pressure relief channels 72, 74 are shown with each having a valve 64 positioned within the respective pressure relief channels 72, 74 in FIG. 3D. It should be noted that during operation the end of the pressure relief channels 72, 74 visible in FIG. 3B would likely be sealed.

It is contemplated that the spring 60 associated with the first pressure relief channel 72 will bias the valve 64 associated therewith by a lesser amount than the amount with which the spring 60 associated with the second pressure relief channel 74 biases the valve 64 associated therewith. That is, less pressure within the pump 10 will be required to open the valve in the first pressure relief channel 72 than the pressure required to open the valve in the second pressure relief channel 74. Because the cross-sectional area of the first pressure relief channel 72 may be less than that of the second pressure relief channel 74, a lower volume of pressurized fluid may exit the pump 10 when the valve 64 in the first pressure relief channel 72 is open than when the valve 64 in the second pressure relief channel 74 is open. Accordingly, with properly sized first and second pressure relief channels 72, 74 and springs 62 placed therein, the pump 10 may be prevented from operating with insufficient fluid therein, which typically occurs when a larger valve 64 opens with the engine running at idle or close to idle speeds. Such operating conditions often occur with prior art pumps due to the large volume of pressurized fluid that exits the pump 10 when a pressure bypass valve is opened.

In one aspect of the cover housing 30 having two pressure relief channels 72, 74, the valve 64 associated with the first pressure relief channel 72 and associated components may be sized and configured so that that valve 64 is sensitive to pressures indicative of idle engine speeds for an internal combustion engine and also configured for optimal performance with volumetric flow rates typical of idle engine speeds (2-3 gallons per minute (GPM)). The valve 64 associated with the second pressure relief channel 74 and associated components may be sized and configured so that that valve 64 is sensitive to pressures indicative of higher engine speeds and also configured for optimal performance with volumetric flow rates typical of higher engine speeds (4-16 GPM).

The drive and idler gears 40, 50 shown in FIGS. 5A and 5B may be each fashioned with an equal number of drive gear and idler gear teeth 44, 54. As is readily apparent, the axial surface of the drive gear 40 visible in FIGS. 5A and 5B (which is the surface of the drive and idler gears 40, 50 that is adjacent the cover housing 30 when the pump 10 is assembled) may include a drive gear tooth dimple 46 in each drive gear tooth 44. Similarly, the visible axial surface of the idler gear 50 may include an idler gear tooth dimple 56 in each idler gear tooth 54. The drive and idler gear tooth dimples 46, 56 may provide a pocket for lubricant to migrate to the space between the axial surface of the drive and idler gears 40, 50 and the cover housing 30. This may allow more lubricant to migrate to areas of the pump 10 that may be typically high-wear, and thus increase the efficiency and longevity of the pump 10. Testing has shown that drive gear tooth dimples 46 and idler gear tooth dimples 56 may reduce the energy requirement on a thirty amp motor by as much as five amps. It is contemplated that drive gear tooth dimples 46 and idler gear tooth dimples 56 may be fashioned on each axial surface of both the drive gear 40 and idler gear 50 in certain applications. Typically the drive and idler gears 40, 50 may be configured so there is between two and four thousandths-of-an-inch play in the axial dimension between the drive and idler gears 40, 50 and the gear chamber 35. The dimples 46, 56 as shown herein may be generally spherically shaped voids, but may have other shapes and/or configurations in embodiments of the pump 10 not pictured herein.

Figure 6A:
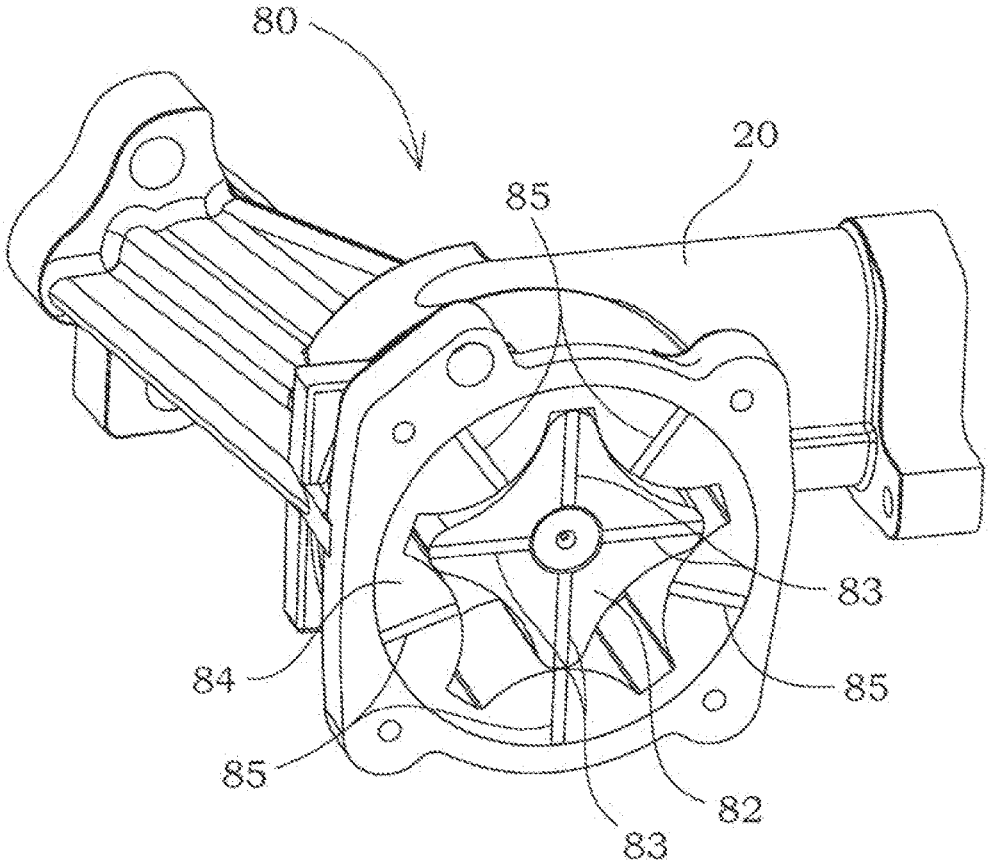
FIG. 6A provides a perspective view of a first embodiment of a rotary pump gear set constructed according to one aspect of the present disclosure positioned in one embodiment of a main body.
Figure 6B:
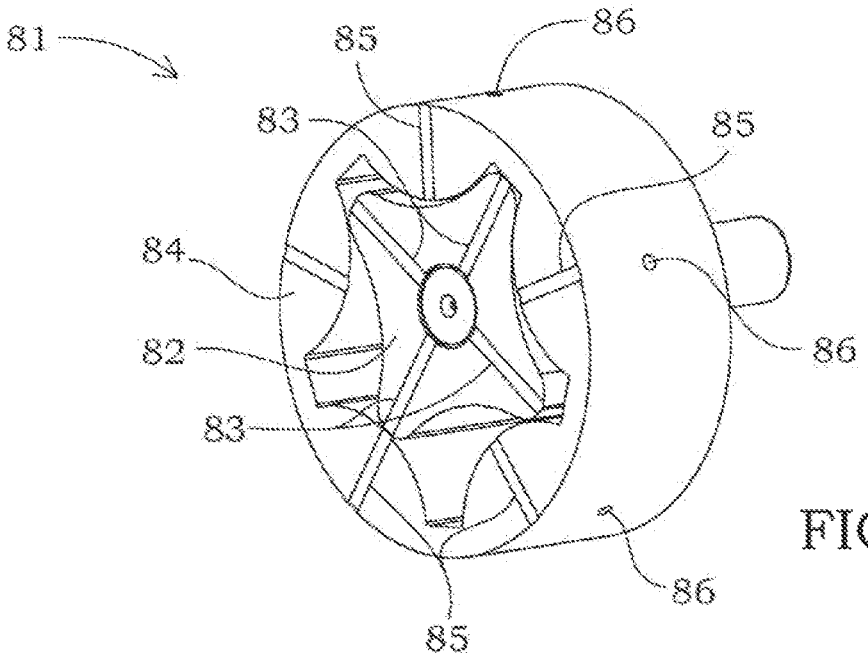
FIG. 6B provides a perspective view of the first embodiment of a rotary pump gear set constructed according to one aspect of the present disclosure.
Figure 6C:
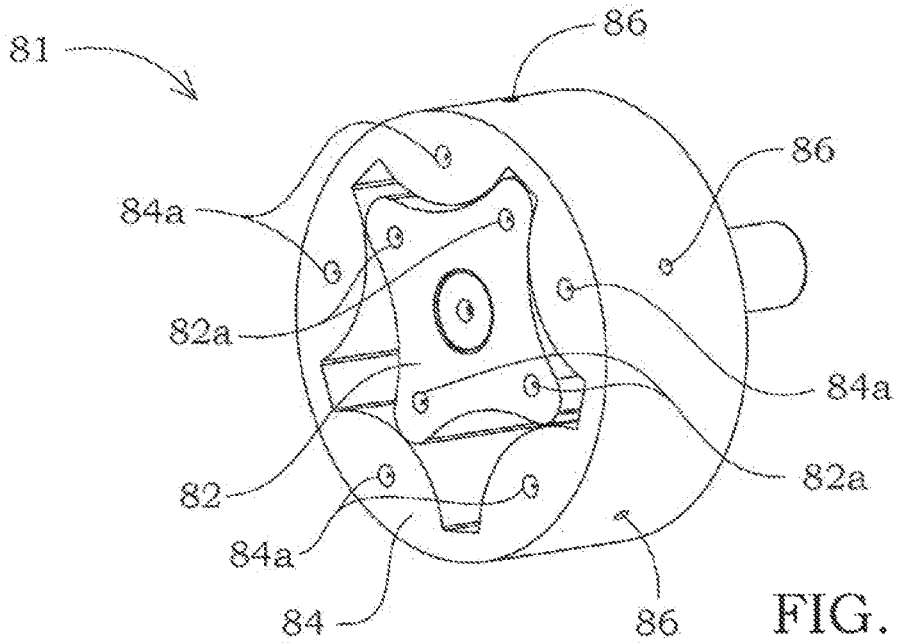
FIG. 6C provides a perspective view of a second embodiment of a rotary pump gear set constructed according to one aspect of the present disclosure.

One embodiment of a rotary pump 80 is shown in FIG. 6A, which may also be used with various aspects and/or features of the pump 10 as disclosed and claimed herein. Rotary pumps 80 generally include a main body 20 and a rotary gear set 81, which includes at least one rotor gear 82 and a stator ring gear 84 surrounding each rotor gear 82. Two different embodiments of rotary gear sets 81 are shown in FIGS. 6B and 6C, respectively, both of which may be used with the embodiment of the main body 20 shown in FIG. 6A. The rotary gear set 81 shown in FIG. 6C may include rotor dimples 82*a* fashioned in the axial surface of the rotor gear 82 and stator dimples 84*a* fashioned in the axial surface of the stator ring gear 84. As with the drive and idler gears 40, 50 as explained above, the rotor and stator dimples 82*a*, 84*a* may provide cavities into which lubricant may migrate during operation of the rotary pump 80. Pumps 10 other than gear or rotary pumps 80 as pictured and described herein may benefit from fashioning dimples in the rotating and/or stationary components of the pump, such as centrifugal pumps, peristaltic pumps, or any other type of pump 10 known to those skilled in the art. Accordingly, the dimpling method and/or structures as disclosed and claimed herein are not limited by the specific type of pump, pump system, and/or pump component that is configured with dimples.

Another aspect of a rotary pump gear set 81 is shown in FIG. 6B. The rotor gear 82 as shown in FIG. 6B may be fashioned with rotor grooves 83 in an axial surface thereof, and the stator ring gear 84 is fashioned with stator grooves 85 in an axial surface thereof. The rotor grooves 83 and stator grooves 85 may cooperate to pressure balance the rotary pump 80 during operation as they may facilitate cross flow of pressurized fluid from areas of high fluid volume (such as the bottom portion in FIG. 6B) to areas of low fluid volume (such as the top portion in FIG. 6B). Accordingly, a rotary pump 80 with a rotary pump gear set 81 fashioned with rotor and stator grooves 83, 85 may operate more smoothly and efficiently, and such a pump 10 will have increased longevity. Four rotor and stator grooves 83, 85 are shown in the embodiment pictured in FIG. 6B, but a lesser or greater number of rotor and/or stator grooves 83, 85 may be used in other aspects of the rotary pump gear set 81. Furthermore, although the rotor grooves 83 and stator grooves 85 are shown as being oriented at an angle of ninety degrees respective to the adjacent rotor grooves 83 and stator grooves 85, respectively, other orientations may be used depending on the number of rotor and/or stator grooves 83, 85 without departing from the spirit and scope of the pump system as disclosed and pump 10 as claimed herein.

The embodiments of the rotary pump gear set 81 shown in FIGS. 6B and 6C also may include a plurality of stator radial bores 86 fashioned in the stator ring gear 84. Each stator radial bore 86 may extend from the outer radial surface of the stator ring gear 84 (i.e., the surface of the stator ring gear 84 that interfaces the main body 20, as shown in FIG. 6A) to the inner radial surface thereof (i.e., the surface of the stator ring gear 84 that interfaces the rotor gear 82). The stator radial bores 86 may be positioned in the axial centerline of the stator ring gear 84. The stator radial bores 86 may allow a predetermined amount (which amount may be dependent at least on the cross-sectional area of the stator radial bores 86) of pressurized fluid from the rotary pump gear set 80 to flow from the area between the rotor gear 82 and stator ring gear 84 to the area between the stator ring gear 84 and the main body 20. Accordingly, the stator radial bores 86 may facilitate constant lubrication the rotary pump 80 with localized high pressure fluid, which may increase the efficiency and longevity of a pump 10 so configured. The embodiments shown in FIGS. 6B and 6C may include a total of four stator radial bores 86, wherein each stator radial bore 86 may oriented by ninety degrees with respect to adjacent stator radial bores 86. However, in other aspects, a different amount of stator radial bores 86 may be used and the orientation thereof may be different than shown in the embodiments pictured herein.

Figure 7A:
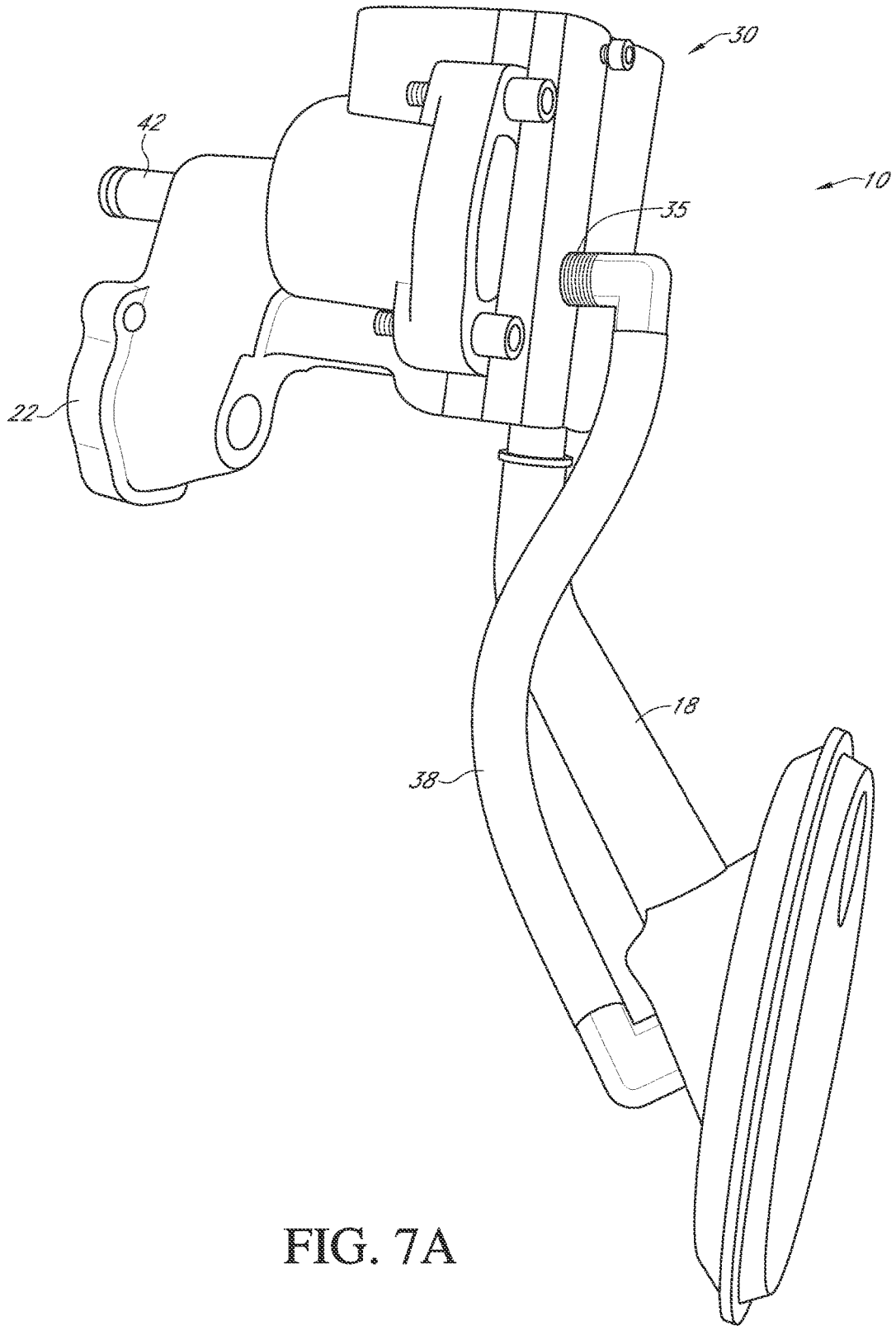
FIG. 7A provides a perspective view of an illustrative embodiment of a pump with a return channel configured therein.
Figure 7B:
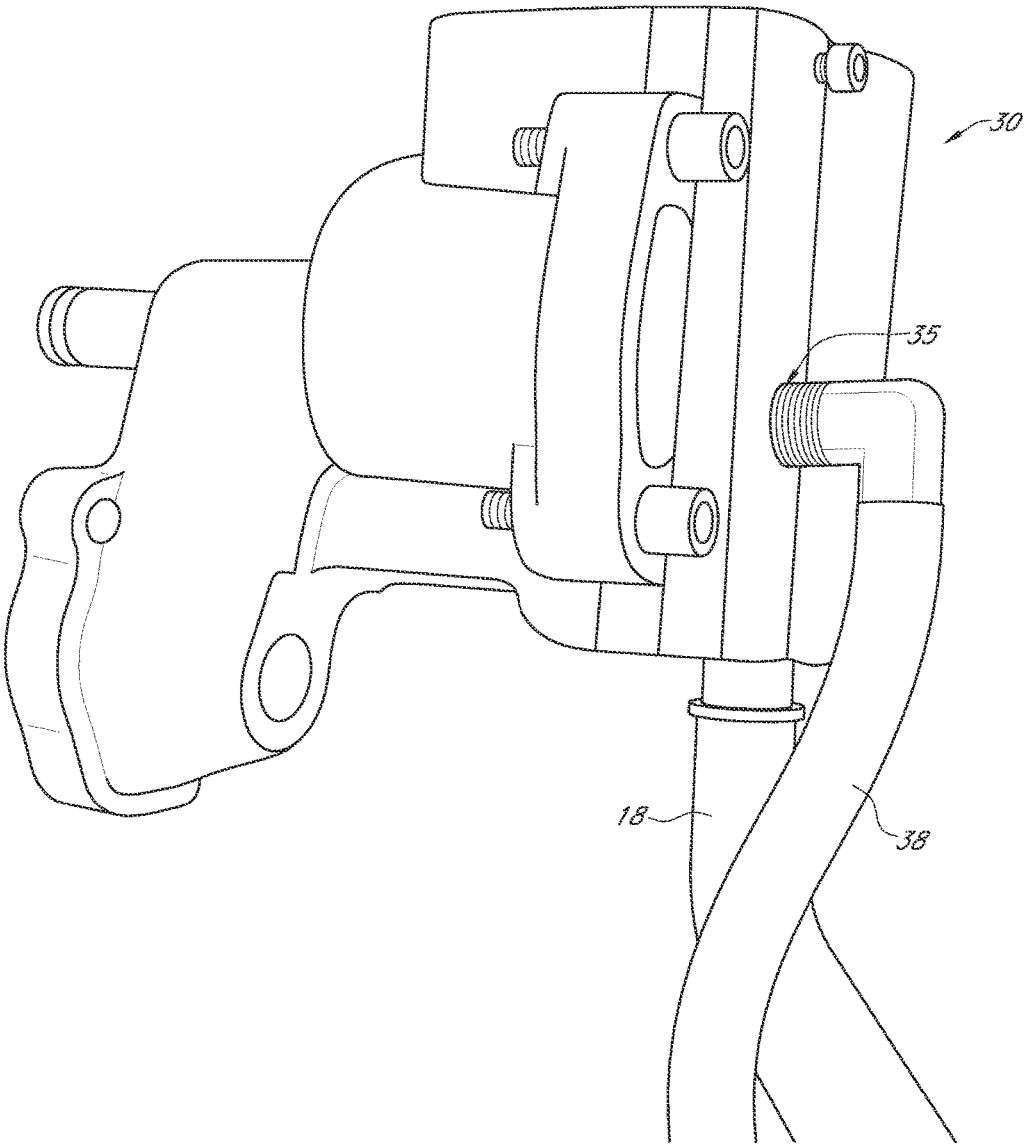
FIG. 7B provides a detailed view of the interface between the cover housing and the return channel.
Figure 7C:
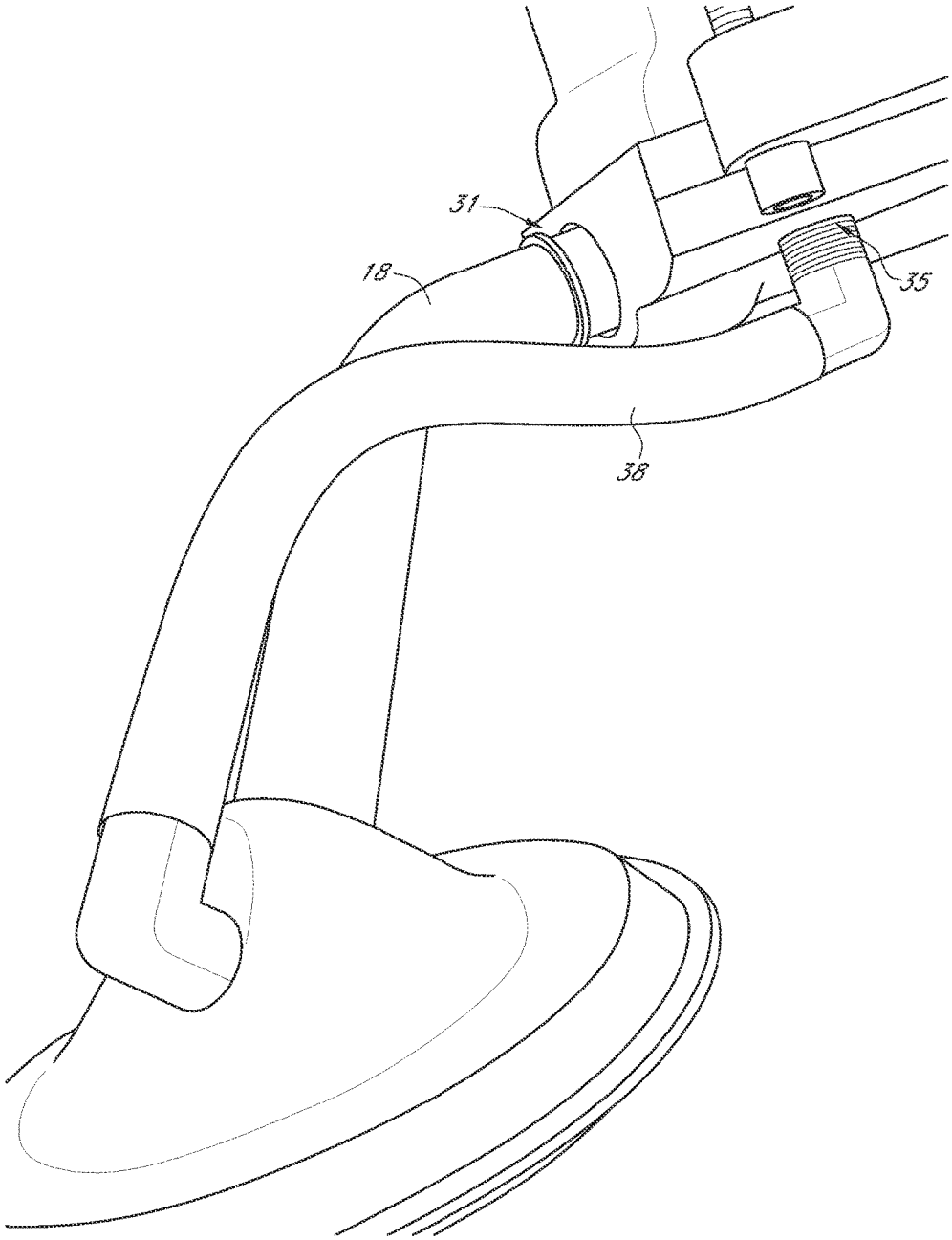
FIG. 7C provides a detailed view of the interface between the pick-up tube and the return channel.

FIGS. 7A-7C provide several view of an illustrative embodiment of a pump 10 configured with a return channel 38. The return channel 38 may be in fluid communication with the pressure relief outlet 35 formed in the cover housing 30. The return channel 38 may also be in fluid communication with the pick-up tube 18, which pick-up tube 18 may be engaged with the cover housing 30 adjacent the inlet channel 31 as shown in FIG. 7C.

The return channel 38 may serve to communicate and route fluid expelled from the pump 10 via the pressure relief outlet 35 to the pick-up tube 18, and subsequently to the inlet channel 31. Accordingly, under certain conditions a pump 10 configured with a return channel 38 may require less power applied to the drive gear shaft 42 to generate desired flow characteristics (e.g., pressure, temperature, volumetric flow rate, etc.) at the pump outlet passage 22*d*. Accordingly, in such a pump 10, pressurized fluid discharged through the pressure relief outlet 35 may be routed to the intake side of the pump 10 instead of being returned to the sump. This results in what may be a more energy efficient design. It is estimated that in certain applications a pump 10 configured with a return channel 38 may require from 10-60% less energy to develop equal flow characteristics at the pump outlet passage 22*d* compared to a similar pump 10 without the return channel 38.

The interface between the pick-up tube 18 and the return channel 38 may be adjusted for optimal performance for a specific application. It is contemplated that in some applications it will be beneficial for that interface to be closer to the distal end of the pick-up tube 12 as a larger volume of fluid may be present in the pick-up tube 12 upstream with respect to the interface as compared to an interface located relatively closer to the inlet channel 31. Additional fluid volume may act as a buffer in certain operating conditions that might otherwise lead to inadequate fluid volume on the intake side of the pump 10.

Additionally, it is contemplated that in some applications it will be desirable to have the return channel 38 configured so that fluid exiting the return channel 38 is traveling generally parallel to fluid within the pick-up tube 12 during operation (i.e., toward the inlet channel 31). In some embodiments this will require a U-shaped (or fish hook) adaptor between the return channel 38 and the pick-up tube 18 as opposed to the 90-degree elbow shown in the illustrative embodiment. The outlet of this adaptor may be positioned directly in the center of the pick-up tube 18 on the interior thereof.

In another aspect of a pump 10 configured with a return channel 38, the pick-up tube 18 and the return channel 38 may be cast into an integral piece having a first bore to serve as an pick-up tube 18 and a second bore to serve as a return channel 38. One end of such an integrated structure may be configured to engage both the inlet channel 31 (at the pick-up tube 18 bore) and pressure relief outlet 35 (at the return channel 38 bore). Alternatively, the return channel 38 and pick-up tube 18 may be rigid parallel tubes, which may or may not be engaged with one another for purposes of structural rigidity and/or robustness. Any embodiment may use a return channel 38 cast into a housing, tubular metallic metal, and/or high-pressure synthetic material.

It is further contemplated that the cover housing 30 may be configured to better accommodate such embodiments, wherein the pressure relief outlet 35 may be located adjacent the inlet channel 31 by the pick-up tube interface 31*a* (FIG. 3C). Accordingly, the return channel 38 and pick-up tube 18 may be secured to the pump 10 at a single location.

A pump 10 configured with a return channel 38 may have several advantages over similar pumps 10 without a return channel 38. For example, a return channel 38 may: (1) enhance the intake suction flow to the gear chamber 25 by providing a pressurized flow to the inlet channel 31; (2) promote additional fluid flow aiding atmospheric pressure and suction of oil pump gears 40, 50 in mesh; (3) transition operational engine horsepower from wasted energy to applied recycled closed-loop pressurized oil stream to the intake side of the pump; (4) benefit the sump oil pool depth with pick-up tube 18 submerged because the oil injected into the intake side of the pump 10 is not dependent on gravity to drain into sump to be available for the pick-up tube 18, which may be especially useful in vehicles and/or operational situations in which the orientation of the pump 10 changes (e.g., off road use, aviation, etc.); and, (5) increase engine horsepower efficiency because spent volumetric pressurized oil is redirected into a closed-loop energy system on the intake side of the pump 10.

Another embodiment of a rotary pump 80 having certain features according to the present disclosure is shown in FIGS. 8A-10. It is contemplated that the type of rotary pump 80 shown in FIGS. 8A-10 may be configured for use as an oil pump for internal combustion engines, wherein the rotary pump 80 may receive rotational energy from a crankshaft of the engine. Additionally, the illustrative embodiment of a rotary pump 80 shown in FIGS. 8A-10 may be configured such that it is may be mounted to the front of the engine such that generally the surface shown in FIG. 8C may be positioned facing the engine block and the surfaces shown in FIGS. 8A, 8B, and 9-10 may be positioned such that they do not face the engine block. However, other uses and/or orientations for the rotary pump 80 exist, and therefore the scope of the present disclosure is in no way limited by the specific application for which a rotary pump 80 is designed.

Figure 8A:
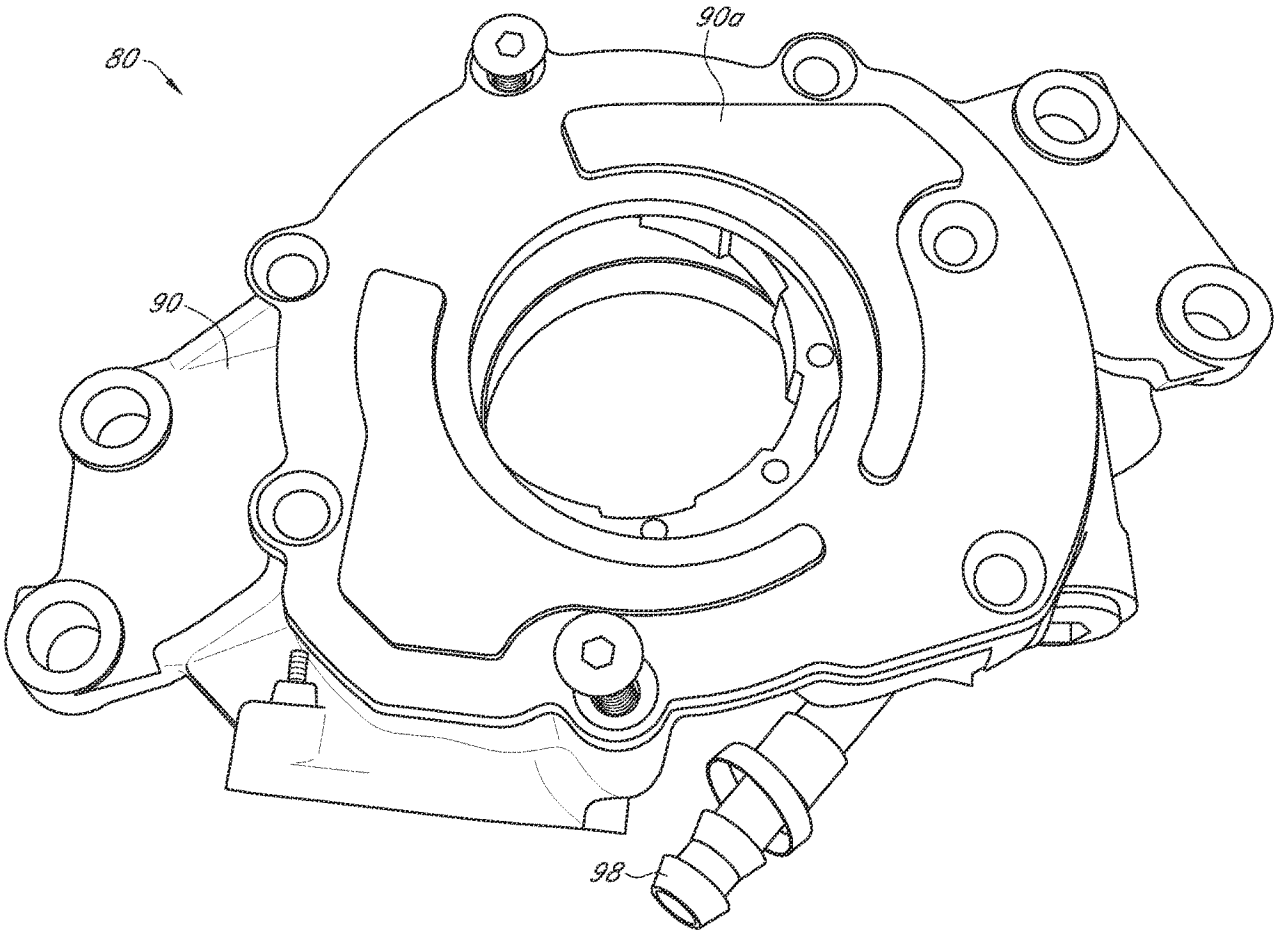
FIG. 8A provides a front perspective view of an illustrative embodiment of a pump configured with an energy recovery system.
Figure 8B:
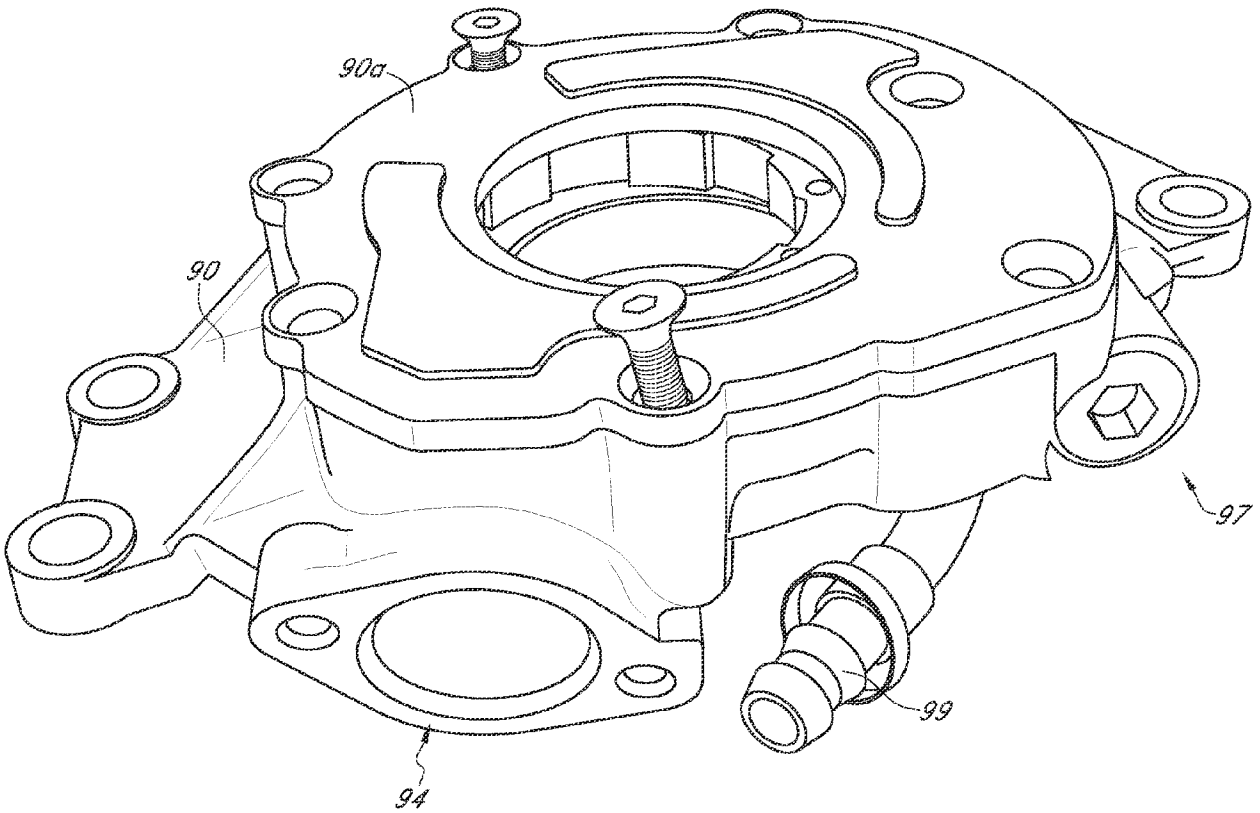
FIG. 8B provides a lower front perspective view of the illustrative embodiment shown in FIG. 8A.

As shown in FIG. 8A, an aspect of a rotary pump 80 may comprise a rotary cover 90*a* that is selectively engageable with a rotary housing 90. The illustrative embodiment of a rotary pump 80 may be configured with an inlet 94, which may be formed in the rotary housing 90. The illustrative embodiment may also include a pressure relief portion 97, which may be positioned within or adjacent to the rotary housing 90. A return tube 99 may be engaged with the rotary housing 90, which return tube 99 is described in further detail below.

Figure 8C:
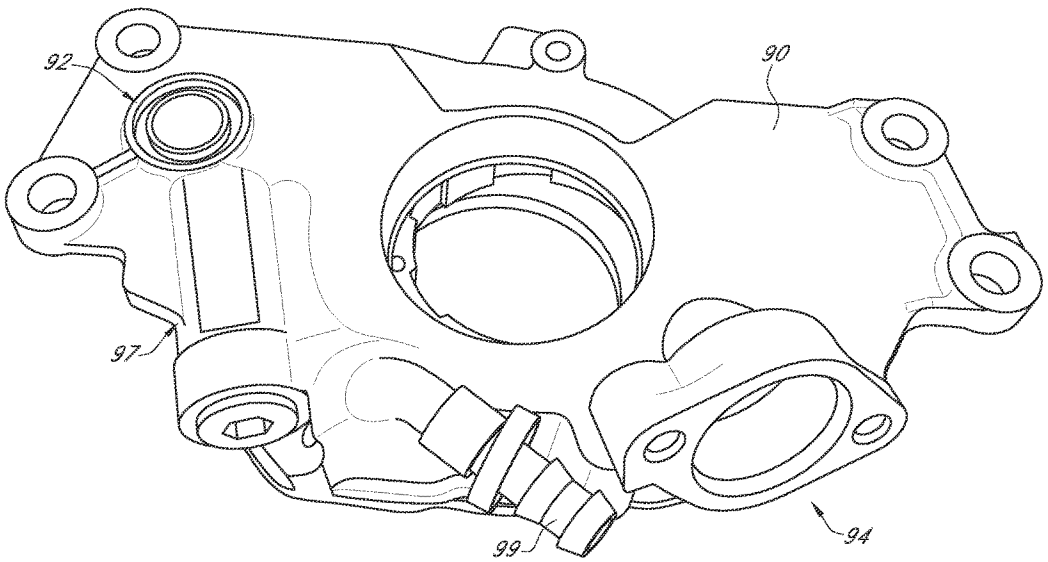
FIG. 8C provides a rear perspective view of the illustrative embodiment shown in FIGS. 8A & 8B.

A back side of an illustrative embodiment of a rotary pump 80 is shown in FIG. 8C. It is contemplated that for the illustrative embodiment, this side may be facing the engine block when the rotary pump 80 is in use. An outlet 92 may be formed in the rotary housing 90. Depending on the application, the outlet 92 may directly abut a portion of the engine block such that pressurized oil flows directly from the rotary pump 80 to the engine block via an interface between the outlet 92 and a corresponding aperture in the engine block, which interface may be sealed via an O-ring. However, the scope of the present disclosure is in no way limited by the structure and/or methods employed to transfer oil from the rotary pump 80 to the engine and/or components thereof.

Figure 9:
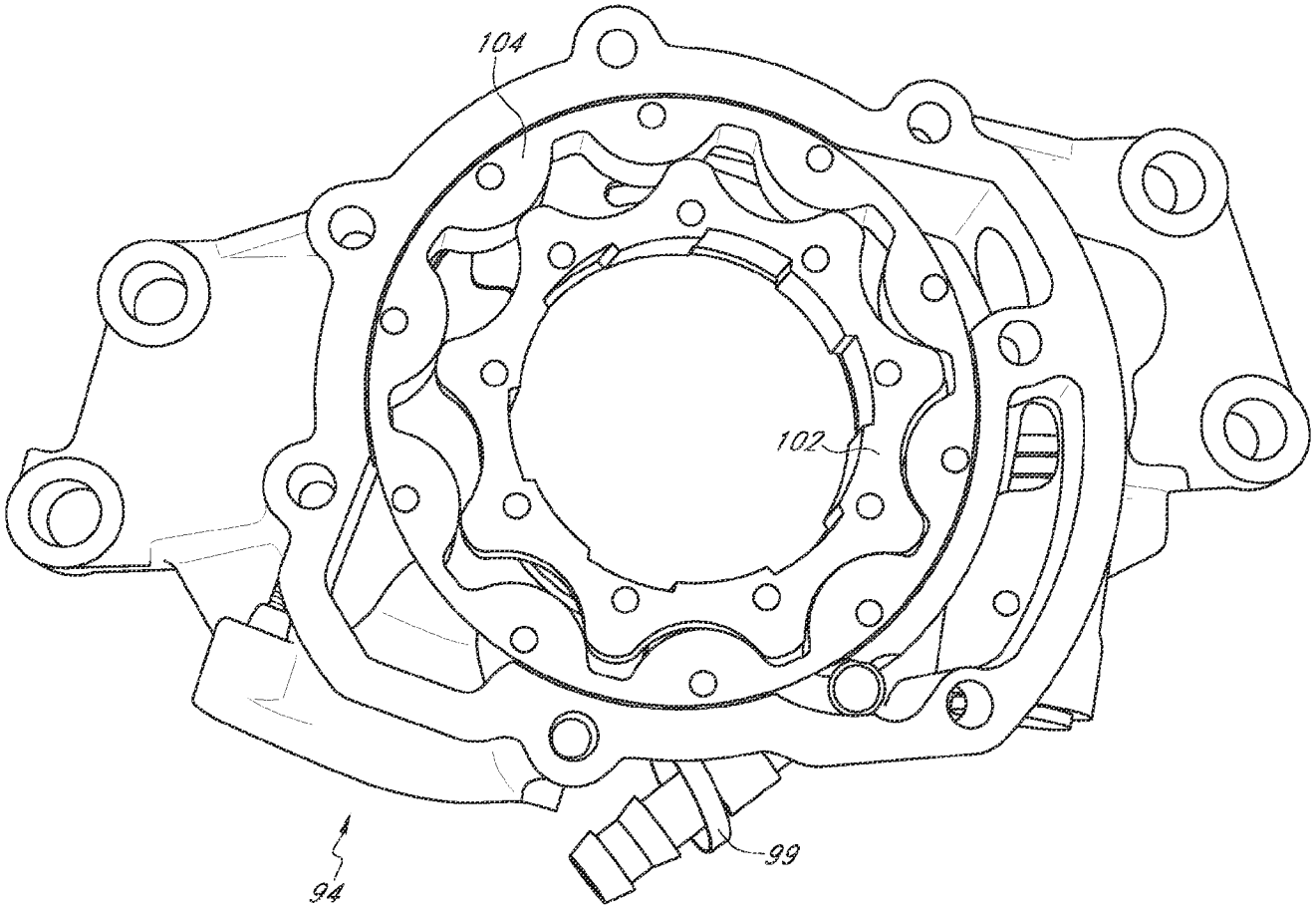
FIG. 9 provides a front perspective view of the illustrative embodiment shown in FIGS. 8A-8C with the cover removed.

FIG. 9 shows the illustrative embodiment of a rotary pump 80 with the rotary cover 90*a* removed. As shown, a ring gear 104 may be positioned in an internal portion of the rotary pump 80 between the rotary housing 90 and the rotary cover 90*a*, and an inner gear 102 may be positioned inside a portion of the ring gear 104. Additionally, the inner gear 102 and/or ring gear 104 may be configured with dimples, grooves, and/or bores as previously described herein for other embodiments of a rotary pump 80.

Figure 10:
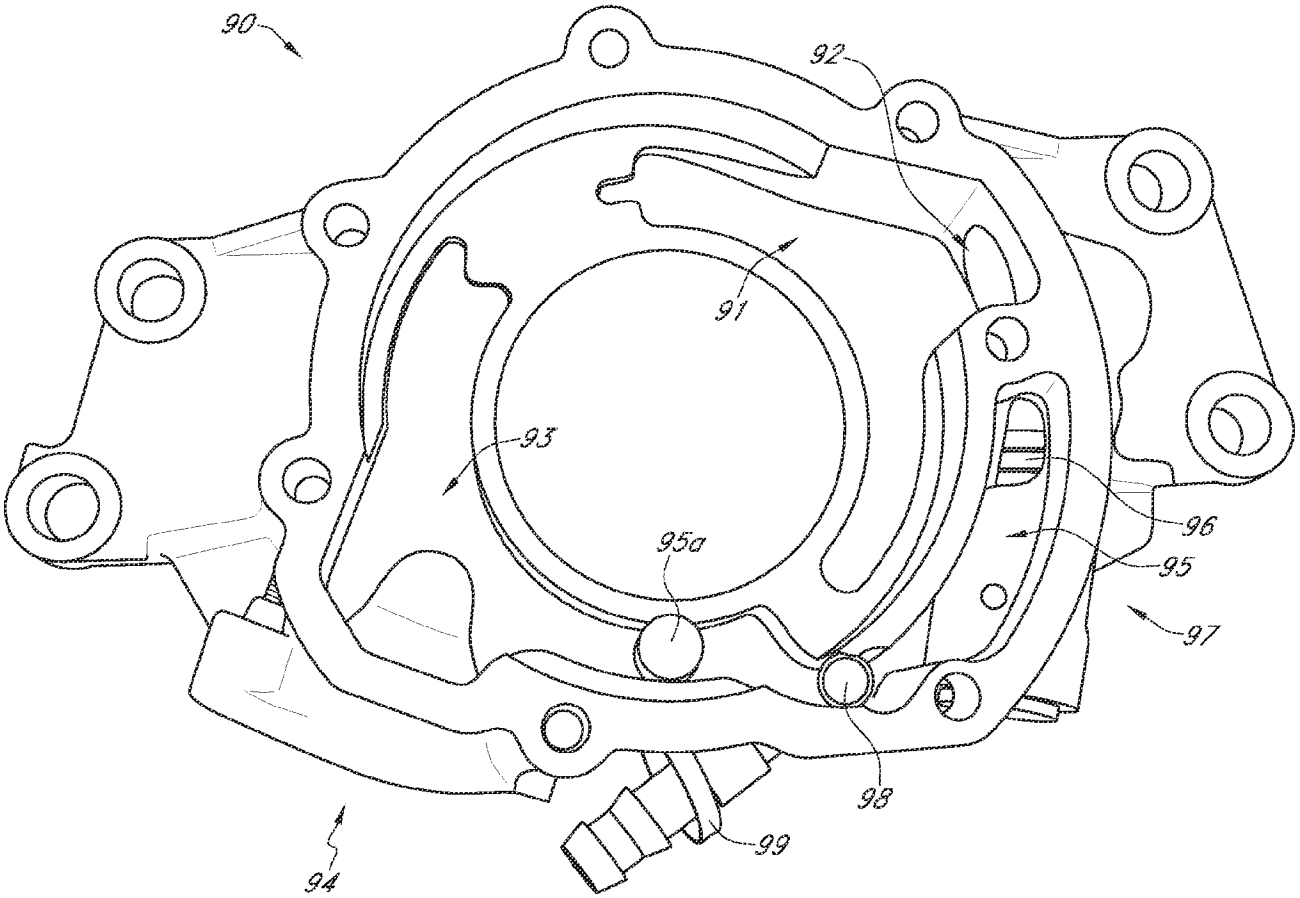
FIG. 10 provides a front perspective view of the illustrative embodiment shown in FIGS. 8A-9 with the cover and rotary gear set removed.

A front portion of an illustrative embodiment of a rotary housing 90 with the cover 90*a* and the ring gear 104 and inner gear 102 removed is shown in FIG. 10, which provides a view of the interior portion of a rotary housing 90. Generally, the interior of the illustrative embodiment of a rotary housing 90 may be formed with an inlet cavity 93 in fluid communication with the inlet 94 and an outlet cavity 91 in fluid communication with the outlet 92. The pressure relief portion 97 may also be in fluid communication with the outlet 92 and/or outlet cavity 91.

Generally, the pressure relief portion 97 may be configured to provide a bypass channel for pressurized oil discharged from the rotary pump 80 if the pressure of the oil is at or above a specific threshold. The pressure relief portion 97 may include internal components (one aspect of which is a spring and valve) designed to open a bypass channel at a specific pump discharge pressure. In an aspect, the internal components may be configured as a helical spring biasing a ball valve against the pump discharge pressure. When the pump discharge pressure overcomes the biasing force of the spring, the ball valve opens so that oil from the pump discharge may flow through the bypass. In some applications a ball valve may be preferable to a plug valve since a ball valve may seat (and therefore seal) better than a plug valve, and a ball valve may generally be immune to binding forces that may interfere with the actuation of a plug valve. However, any other structure and/or method may be used to selectively open a bypass channel without limitation.

The pressure relief portion 97 may be configured with a pressure relief discharge 96, such that when the pump discharge pressure reaches or exceeds the set threshold of the pressure relief portion 97, oil is routed through a part of the pressure relief portion 97 and out the pressure relief discharge 96 (i.e., a bypass channel is opened, the outlet of which is the pressure relief discharge 96). The pressure relief discharge 96 may be in fluid communication with the pressure relief cavity 95 formed in the rotary housing 90. A return channel 98 may also be in fluid communication with the pressure relief cavity 95, and may also be in fluid communication with a return tube 99. The return tube 99 may be in fluid communication with the inlet 94, such that pressurized oil passing through the pressure relief portion 97 is routed to the inlet 94 of the rotary pump 80. In this manner, a pressure relief portion 97 configured with a valve and biasing member (e.g., spring) may act as a modulator valve since it may experience a certain magnitude of pressure on either side of the valve. In an aspect, a plug 95*a* may be placed between a pressure relief cavity 95 and the inlet cavity 93 to prevent oil passing through the pressure relief portion 97 from flowing through the pressure relief cavity 95 to the inlet cavity 93.

Generally, a rotary pump 80 shown in FIGS. 8A-10 may provide efficiencies in operation over pumps of the prior art between 4 and 50 percent. Whereas prior art pumps generally wasted the potential energy of pressurized oil passing through the pressure relief portion 97, an aspect of a rotary pump 80 extracts at least a portion of that potential energy by rerouting the pressurized oil to the inlet 94, thereby reducing the amount of energy required to be input to the rotary pump 80 to achieve a certain discharge pressure at certain operating conditions. That is, an aspect of a rotary pump 80 may require less power applied to the inner gear 102 to generate desired flow characteristics (e.g., pressure, volumetric flow rate, etc.) at the outlet 92. The specific efficiency gain over prior art pumps may depend on several factors including but not limited to throttle position of the engine, crankshaft speed, engine wear, fluid characteristics (e.g., viscosity, temperature, etc.), and/or clearances between various elements of the rotary pump 80. Accordingly, the scope of the present disclosure is in no way limited by the actual efficiency gained from employing a rotary pump 80 having one or more features and/or aspects thereof.

Illustrative Embodiment of an Engine

Figure 11:
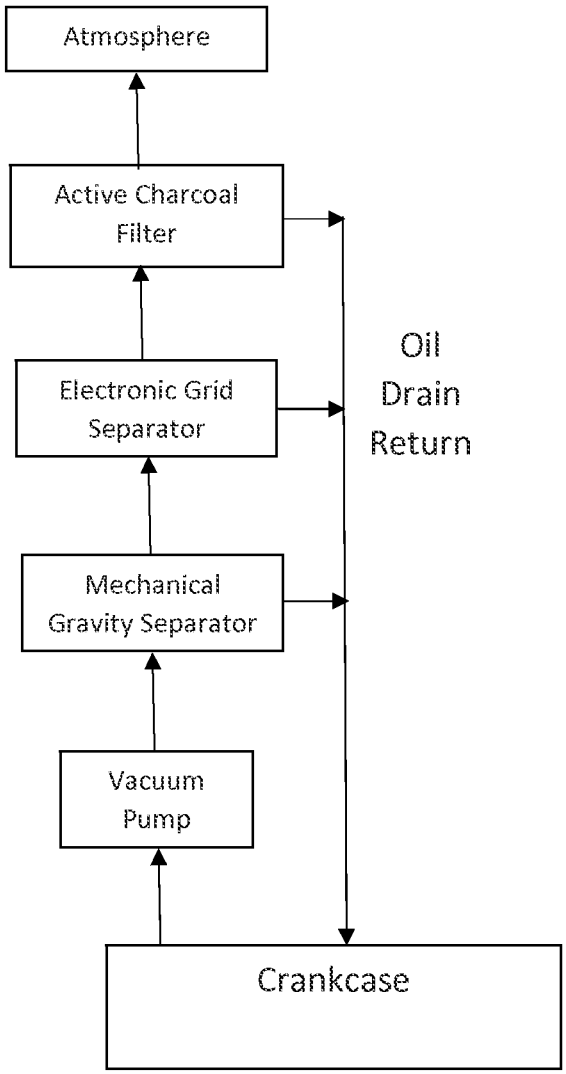
FIG. 11 provides a schematic diagram of an embodiment of a pump system that may use various aspects of the present disclosure.

A schematic diagram of an illustrative embodiment of an engine that may use various embodiments, aspects, and/or features of the pump system disclosed herein is shown in FIG. 11. In an aspect shown in FIG. 11, a portion of the engine, which may be configured as an internal combustion engine, may be operated at a pressure less than atmospheric. It is contemplated that for most embodiments it will be advantageous to operate at least the portion of the engine through which lubricant (e.g., oil) flows at a pressure less than atmospheric. In an aspect, this portion of the engine may be generally referred to as a "crankcase," but that term is in no way limiting to the scope of the present disclosure, and any other portion and/or portions of an engine may be operated as less than atmospheric pressure without departing from the spirit and scope of the present disclosure.

A vacuum pump may be in fluid communication with a portion of the crankcase so as to reduce the pressure within the crankcase to an amount less than atmospheric. In one aspect it is contemplated that the optimal amount of pressure reduction within the crankcase may be between 0.5 and 8.5 inches of water. However, other amounts of pressure reduction may be used without limitation. Additionally, it is contemplated that for some applications it may be advantageous to position the vacuum pump as close to the top of the engine as possible so that the vacuum pump draws as little lubricant (e.g., oil) into the intake of the vacuum pump as possible.

The vacuum pump may discharge to a separator, which may be configured as an electrostatic separator. The separator may function to condense lubricant mist and/or small droplets into larger droplets, and the separator may be configured to subsequently condense those larger droplets into a liquid stream and/or large droplets. The separator may be in fluid communication with the crankcase so that the liquid stream and/or large droplets of lubricant may be returned to the crankcase. Additionally, the crankcase may be in fluid communication with the separator such that lubricant mist occurring in a portion of the crankcase may move to the separator independently of the vacuum pump, such that the separator may act upon that lubricant mist and return that lubricant mist to the crankcase. The separator may also include a purge stream, which may be vented to the exhaust of the engine or a different location, depending on the specific application.

In an aspect, the separator may comprise multiple stages. As shown in FIG. 11, the discharge of the vacuum pump may feed into a mechanical gravity separator. A mechanical gravity separator may constitute a first stage of separation, wherein a liquid stream from the mechanical gravity separator may discharge to the crankcase and a vapor stream from the mechanical gravity separator may feed into an electronic grid separator. An electronic grid separator may constitute a second stage of separation, wherein a liquid stream from the electronic grid separator may discharge to the crankcase and a vapor stream from the electronic grid separator may feed into an active charcoal filter. An active charcoal filter may constitute a third stage of separation, wherein a liquid stream from the active charcoal filter may discharge to the crankcase and a vapor stream from the active charcoal filter may exhaust to the atmosphere.

In an aspect, the flow characteristics (volumetric flow rate, pressure differential, etc.) of the vacuum pump may be dictated by the rate of speed at which the engine is turning. Accordingly, the engine may be configured such that the amount of vacuum applied to the crankcase is constant and/or relatively constant independent of the engine speed and/or other operating conditions of the engine. Such a configuration may require various electronic controllers and/or communication pathways between the engine control unit and the vacuum pump, by-pass valves and/or other plumbing associated with the vacuum pump or other components of the engine, and/or check valves and/or control valves to prevent and/or control the flow of various fluids and/or gases within the engine. All such components and/or combinations thereof are within the scope of the present disclosure and any suitable configuration thereof may be used with the engine depending on the specific application thereof.

It is contemplated that an aspect of an engine according to the present disclosure may require a pump system 10 similar and/or corresponding to those shown in FIGS. 1-10. However, other types of pumps and/or pump systems 10 may be used without limitation, and specifically pumps and/or pumps systems capable of suitable operation at or below atmospheric pressure.

It is further contemplated that an aspect of an engine according to the present disclosure may be more economical to operate than a prior art engine. In an aspect, the present art engine may increase the amount of lubricant volume and/or pressure to various engine components, and may also be employed with engines having a vacuum pan. This may allow the engine to function in environments wherein the ambient pressure is less and/or considerably less than 1 atm (e.g., less than 0.1 atm). Accordingly, an aspect of the present engine may increase longevity, power output, and lubricant flow as compared to prior art engines. Additionally, an aspect of an engine configured according to the present disclosure may be up to 50% more efficient than a similar prior art engine. Furthermore, an aspect of the present engine according may experience less lubricant leakage through piston rings and/or valve guides than similar prior art engines. The illustrative embodiment of a pump, pump system, engine, and/or aspect thereof disclosed herein may have other benefits over prior art engines without limitation. The preceding benefits mentioned herein are by no way exhaustive and/or limiting, and are included for illustrative purposes only.

The various contours, shapes, dimensions, and/or general configuration of the outlet cavity 91, outlet 92, inlet cavity 93, inlet 94, pressure relief cavity 95, pressure relief discharge 96, pressure relief portion 97, return channel 98, and/or return tube 99 may vary from one embodiment and/or aspect of the rotary pump 80 to the next, and are therefore in no way limiting to the scope of the present disclosure. Additionally, the specific shape of the rotary housing 90 and/or cover 90*a* may vary from one embodiment of the rotary pump 80 to the next, as may the specific mounting requirements of the rotary pump 80 and/or engagement points between the rotary pump 80 and engine and/or other structure. Accordingly, the scope of the present disclosure is in no way limited by the specific engine and/or brand of engine for which the rotary pump 80 is configured. That is, the rotary pump 80 extends to all types, brands, and/or uses of a rotary pump 80 wherein the application of the rotary pump 80 may benefit from one or more features and/or aspects thereof disclosed herein.

The pump 10, main body 20, cover housing 30, return channel 38, drive gear 40, idler gear 50, pressure relief assembly, rotary gear set 81, rotary pump 80, and various elements thereof may be constructed of any suitable material known to those skilled in the art. In the embodiments pictured herein, it is contemplated that most elements will be constructed of metal or metallic alloys, polymers, or combinations thereof. However, other suitable materials may be used. Any spring 62 used in any embodiment may be constructed of any resilient material having the appropriate load characteristics. For example, rubber, polymer materials, metallic springs, combinations thereof, or any other suitable material may be used for the spring 62.

Having described the preferred embodiments, other features of the present disclosure will undoubtedly occur to those versed in the art, as will numerous modifications and alterations in the embodiments as illustrated herein, all of which may be achieved without departing from the spirit and scope of the present disclosure. Accordingly, the methods and embodiments pictured and described herein are for illustrative purposes only.

Any of the various features for the pump, rotary pump, pump system, engine and/or components thereof may be used alone or in combination with one another (depending on the compatibility of the features) from one embodiment to the next. All of these different combinations constitute various alternative aspects of the present disclosure. The embodiments described herein explain the best modes known for practicing the various aspects of the present disclosure, and will enable others skilled in the art to utilize the same. The claims are to be construed to include alternative embodiments to the extent permitted by the prior art. Modifications and/or substitutions of one feature for another in no way limit the scope of the pump, rotary pump, pump system, engine, and/or component thereof unless so indicated in the following claims.

It should be noted that the present disclosure is not limited to the specific embodiments pictured and described herein, but are intended to apply to all similar apparatuses and methods for increasing the performance, efficiency, and/or providing any other desirable characteristic to a pump, rotary pump, pump system, and/or engine. Modifications and alterations from the described embodiments will occur to those skilled in the art without departure from the spirit and scope of the present disclosure.

The invention claimed is:

1. A rotary pump comprising:

a. a rotary housing configured for selective engagement with an engine, said rotary housing comprising:
   i. an outlet cavity formed in an interior of said rotary housing;
   ii. an outlet in fluid communication with said outlet cavity;
   iii. a pressure relief portion in fluid communication with said outlet cavity;
   iv. a pressure relief discharge in fluid communication with said pressure relief portion;
   v. a pressure relief cavity formed in an interior of said rotary housing, wherein said pressure relief cavity is in fluid communication with said pressure relief discharge;
   vi. a return channel in fluid communication with said pressure relief cavity, wherein said return channel is positioned exterior with respect to said rotary housing;
   vii. an inlet cavity formed in said interior of said rotary housing;
   viii. an inlet in direct fluid communication with said inlet cavity, wherein said inlet fluidly connects said inlet cavity with an exterior environment adjacent said rotary housing, and wherein said return channel is enclosed but for an interface with said pressure relief cavity and a second interface with said inlet channel;

b. a return tube engaged with said rotary housing, wherein a first end of said return tube is in direct fluid communication with said return channel, wherein a second end of said return tube is in direct fluid communication with said inlet, and wherein said return tube is positioned exterior with respect to said rotary housing;

c. a ring gear positioned in said interior of said rotary housing;

d. an inner gear positioned within said ring gear; and, e. a rotary cover that is selectively engageable with said rotary housing so as to cover said interior of said rotary housing.

2. The pump according to claim 1 wherein said return channel is further defined as comprising a metallic tube.

3. The pump according to claim 1 wherein said return channel is further defined as comprising a synthetic tube.

4. The rotary pump according to claim 1 wherein said engine is further defined as an internal combustion engine.

5. The rotary pump according to claim 4 wherein said rotary pump is further defined as receiving rotational energy from a crankshaft of said internal combustion engine.

6. The rotary pump according to claim 5 wherein said internal combustion engine is further defined as including a vacuum pump in fluid communication with a crankcase of said internal combustion engine, wherein said vacuum pump causes a pressure within said crankcase that is less than one atmosphere.

7. The rotary pump according to claim 6 wherein a discharge of said vacuum pump is routed to a separator configured to remove liquid and/or vapor lubricant from air.

8. A pump comprising:

a. a main body having a gear chamber formed therein, wherein said main body is formed with an outlet port and a pump outlet passage fluidly connecting said gear chamber to said pump outlet port, wherein said main body includes an inlet channel in fluid communication with said gear chamber, and wherein said inlet channel fluidly connects said gear chamber with an exterior environment adjacent said pump;

b. a drive gear positioned in said main body;

c. an idler gear positioned in said main body;

d. a pressure relief assembly in fluid communication with said pump outlet passage, wherein said pressure relief assembly includes a pressure relief outlet, and wherein said pressure relief outlet connects an interior of said main body with said exterior environment; and, e. a return channel fluidly connecting said pressure relief outlet to said inlet channel such that said return channel provides a direct fluid path from said pressure relief outlet to said inlet channel, wherein said return channel is enclosed but for an interface with said pressure relief outlet and a second interface with said inlet channel, wherein a first end of said return channel is in direct fluid communication with said pressure relief outlet, wherein a second end of said return channel is in direct fluid communication with said inlet channel, and wherein all of said return channel is positioned exterior with respect to said main body.

9. The pump according to claim 8 wherein said pump is further defined as being engaged with an internal combustion engine.

10. The rotary pump according to claim 9 wherein said pump is further defined as receiving rotational energy from a crankshaft of said internal combustion engine.

11. The pump according to claim 10 wherein said internal combustion engine is further defined as including a vacuum pump in fluid communication with a crankcase of said internal combustion engine, wherein said vacuum pump causes a pressure within said crankcase that is less than one atmosphere.

12. The pump according to claim 11 wherein a discharge of said vacuum pump is routed to a separator configured to remove liquid and/or vapor lubricant from air.

13. A method of increasing the efficiency of a pump, said method comprising:

a. outfitting said pump with a pressure relief portion formed in a housing of said pump, wherein said pump includes an outlet for a pressurized fluid, wherein said pressure relief portion is in fluid communication with said outlet of said pump, and wherein said pressure relief portion provides a second outlet for said pressurized fluid when a pressure of said pressurized fluid reaches a predetermined value;

b. providing a return channel to directly fluidly connect said second outlet of said pressure relief portion with a return tube;

c. providing an inlet formed in said housing, wherein said inlet fluidly connects an interior of said housing with an exterior environment adjacent said pump, and wherein said return channel is enclosed but for an interface with said second outlet of said pressure relief portion and a second interface with said return tube; and, d. positioning said return tube between said return channel and said inlet, wherein said return tube directly fluidly connects said return channel to said inlet, wherein said return tube and said return channel are exterior with respect to said housing such that any said pressurized fluid within said return tube has been discharged from said pump and expelled therefrom.

14. The method according to claim 13 wherein said pump is further defined as being engaged with an internal combustion engine.

15. The method according to claim 14 wherein said internal combustion engine is further defined as including a vacuum pump in fluid communication with a crankcase of said internal combustion engine, wherein said vacuum pump causes a pressure within said crankcase that is less than one atmosphere.

16. The method according to claim 15 wherein a discharge of said vacuum pump is routed to a separator configured to remove liquid and/or vapor lubricant from air.

* * * * *